US009084943B2

(12) United States Patent
Hickey

(10) Patent No.: US 9,084,943 B2
(45) Date of Patent: Jul. 21, 2015

(54) NATIVITY STABLE STRUCTURE AND KIT FOR SAME

(75) Inventor: David R. Hickey, Darien, IL (US)

(73) Assignee: Cross Tread Industries, Inc., Willow Springs, IL (US)

( * ) Notice: Subject to any disclaimer, the term of this patent is extended or adjusted under 35 U.S.C. 154(b) by 869 days.

(21) Appl. No.: 13/068,728

(22) Filed: May 18, 2011

(65) Prior Publication Data

US 2011/0300312 A1 Dec. 8, 2011

Related U.S. Application Data

(60) Provisional application No. 61/395,912, filed on May 19, 2010.

(51) Int. Cl.

| | |
|---|---|
| ***A63H 33/00*** | (2006.01) |
| ***A63H 33/42*** | (2006.01) |
| ***A63J 1/00*** | (2006.01) |
| ***A47G 33/02*** | (2006.01) |

(52) U.S. Cl.
CPC . *A63J 1/00* (2013.01); *A47G 33/02* (2013.01); *Y10T 29/49716* (2015.01); *Y10T 29/49826* (2015.01)

(58) Field of Classification Search
USPC ..... 446/72, 76, 81, 82, 83, 97, 105, 126, 446/476, 478
See application file for complete search history.

(56) References Cited

U.S. PATENT DOCUMENTS

| | | | | | |
|---|---|---|---|---|---|
| 1,492,560 | A | * | 5/1924 | Fisher | 446/105 |
| D123,192 | S | * | 10/1940 | Schafhausen | D11/123 |
| 3,258,884 | A | * | 7/1966 | Wenger | 52/6 |
| 3,614,840 | A | * | 10/1971 | Vadell | 428/13 |
| 3,906,659 | A | * | 9/1975 | Walmer | 446/110 |
| 4,253,267 | A | * | 3/1981 | Kocolowski | 446/105 |
| 4,857,028 | A | * | 8/1989 | Pail | 446/82 |
| 6,565,413 | B2 | * | 5/2003 | Brownrigg | 446/476 |
| 7,316,598 | B1 | * | 1/2008 | Lock | 446/126 |
| 7,467,985 | B2 | * | 12/2008 | Manrique | 446/147 |
| 2010/0255749 | A1 | * | 10/2010 | Lines | 446/72 |

* cited by examiner

*Primary Examiner* — Nini Legesse
(74) *Attorney, Agent, or Firm* — Pyle & Piontek , LLC

(57) ABSTRACT

The present invention provides a nativity stable structure particularly for use with larger nativity figures (24 inches in height, or greater) which is made of tubular and solid metal bars, rods and sheet members and fittings or connectors that can be economically made, shipped, packaged, assembled, such as in a kit or kits, and used to house the larger nativity figures. When Christmas has passed, the nativity stable structure of the present invention can be easily disassembled and repackaged in its shipping carton(s) and easily stored in compact, minimum footprint and volume. Further sheet flooring is included in the package or kit upon which the nativity figures can be placed. The flooring is made in a plurality of identical segments and is compact and also easily shipped and stored. Further, to facilitate erection of the nativity stable on an uneven ground (and generally lawns are somewhat uneven and should have some slope for drainage), the legs of the nativity stable structure are telescopic and can be fixed at a desired position to level the floor and nativity stable.

50 Claims, 22 Drawing Sheets

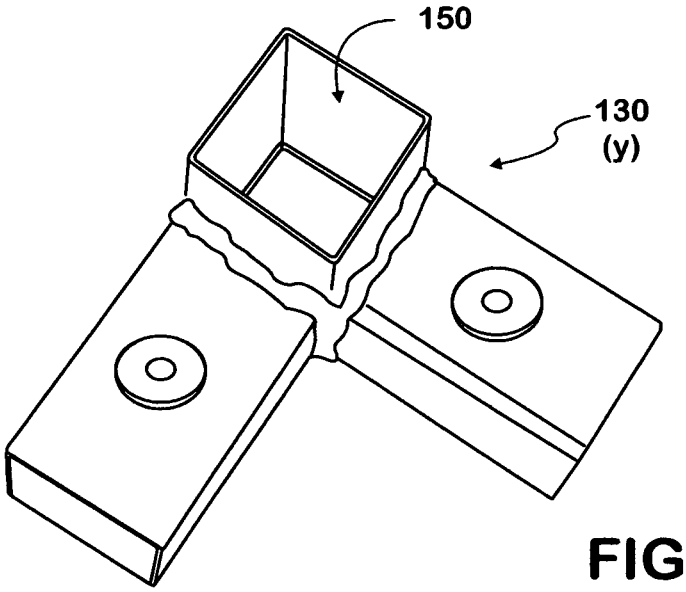
FIG. 5A
FIG. 5B
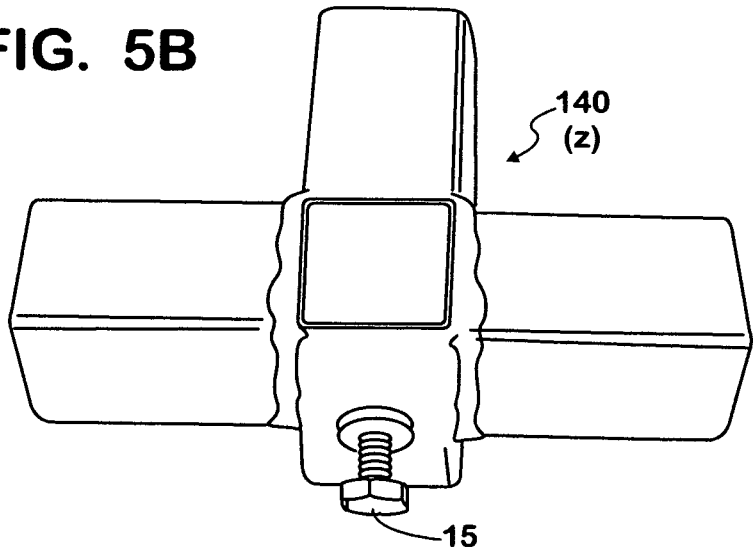

FIG. 10

MANGER SET-UP INSTRUCTIONS
36" MODEL-SECTION "A"

Tools needed: Tape measure, 7/16" socket or wrench (cordless drill w/socket optional), level, marking device.

Parts List (check before starting installation):

66- ¼-20X ½" set bolts
?- ¼-20 Eyebolts
6- 28" legs w/circular feet
4- Corner connectors
2- Rear center T-connectors
2- Front center T-connectors
2- 1¼" x 12" front center leg extensions
2- 1" x 12" front center leg extensions w/circular feet
4- 44" Corner posts
2- 56" Rear center posts
12- 1" x 36" blank tubes
2- 1" x 16" blank tubes
2- 1" x 12" blank tubes
2- Rear offset roof supports
2- Front offset roof supports
6- Roof support rods
8- 10" stakes

FIG. 11

MANGER SET-UP INSTRUCTIONS
36" MODEL-SECTION "B"

Tools needed: Tape measure, 7/16" socket or wrench (cordless drill w/socket optional), level.

Parts List (check before starting installation):

44- ¼-20X ½" set bolts
?- ¼-20 Eyebolts
4- 28" legs w/circular feet
4- Corner connectors
2- 1½" 2-way connectors(installed during sect "A" set-up)
2- 1¼" 2-way connectors(installed during sect "A" set-up)
2- 50" Front corner posts
6- 1" x 36" blank tubes
2- 1" x 24" blank tubes
1- 1" x 16" blank tubes
2- Offset lower platform frame sides
2- Center offset roof supports(double receptacles-install with "A")
6- Roof support rods
4- 10" stakes

NATIVITY STABLE STRUCTURE AND KIT FOR SAME

DISCLOSURE

This application is a United States Non-Provisional Application claiming the priority, benefit and filing date of U.S. Provisional Application Ser. No. 61/395,912, filed on May 19, 2010, of the same title and same inventor, David R. Hickey, said Provisional application which is incorporated by reference herein as is fully set forth, and relates to a nativity stable structure and method for making and providing the nativity stable structure, which could be in the form of a kit for providing the same, particularly one that is economical to build, conveniently shipped, easily erected, used, stored and re-erected, and now includes low voltage lighting for the nativity stable.

BACKGROUND OF THE INVENTION

Nativity scenes are frequently erected around Christmas time, and they usually utilize figures small enough to put under a Christmas tree. These figures are placed in and about a nativity stable. When the figures are small, say 6 inches in height or less, the nativity stable is small, say a foot or less in height and is generally formed as a completed structure.

Now nativity figures are available in larger and different heights, for example, 24 inches, 36 inches, 50 inches and 60 inches, and may be even larger.

Now a nativity stable structure to house the larger figures will increase with the size of the figures. With the figure sizes shown in the Table 1 below, a suitable stable size might be at least:

TABLE 1

| | * Nativity Stable Size for: A or (A + B) | | | | |
|---|---|---|---|---|---|
| Figure Size Inches | Width Inches | Depth Inches | Height Inches | Erected Vol. $Ft^3$ | Erected Footprint Area $Ft^2$ |
| 24 | 76 | 39 | 63 | 108 | 21 |
| 36 | 89 | 39 (76) 71 | | 143 (273) | 24 (47) |
| 50 | 125 | 51 (100) | 81 | 299 (587) | 44 (87) |
| 60 | 125 | 51 (100) | 89 | 329 (645) | 44 (87) |
| 72 | 144 | 60 (118) | 97 | 485 (954) | 60 (118) |
| others | 1.5 to 2.5 × Figure Height | 0.8 to 2.5 × (2 to 2.5) × Figure Height | 1.5 to 3 × Figure Height | 4 to 7 × (8 to 14) × Figure Height | 0.7 to 1 × (1.3 to 2) Figure Height |

* Based on utilization of present invention herein disclosed Kit A and (Accessory Kit B) and NOT the prior art.

As can be seen from the above, with larger size figures, the nativity stable needs to be quite large, and if made of conventional construction of studs, floor beams, rafters and covering sheets of wood, be heavy, expensive to build, take up a large volume and footprint or floor space, may not be deconstructable, is difficult to move and/or store and require large equipment to move, and would require a large storage area. See footprints and erected volumes above. For the foregoing reasons, many nativity displays with large figures as above have no nativity stable at all, and the figures, which can be quite expensive (say from $300.00 to $4,500.00 dollars each), are merely set outside in the environment. Due to weather elements or weather conditions (ice, snow, sleet, etc.) and sunlight exposure, being outside can also accelerate discoloration and/or deterioration of the figures. Further, there being no protective structure may make it more difficult to secure and prevent theft of these expensive figures. Without a nativity stable, optimum displays, such as including domestic animals, angels, etc. thereabout might not be made. Further, if a conventional nativity stable for larger size figures is to be constructed, then due in part to its larger size, the ground conditions and unevenness must be taken into account when building the conventional nativity stable structure, and doing so would further increase costs and expense, and can limit the ability to place the nativity stable and nativity scene on the ground in a desired location, and when the season is over prevent movement of the conventionally built nativity stable to another location and/or storage of the same.

SUMMARY OF THE INVENTION

The present invention provides a nativity stable structure particularly for use with larger (say 24 inches height on up) nativity figures, which structure is made of tubular and solid metal bars, rods and sheet members and connecting fittings that can be economically made, packaged, shipped, assembled, such as in a kit, and used to display and/or house the larger nativity figures. When Christmas has passed, the nativity stable structure of the present invention can be easily disassembled and repackaged in its shipping carton and easily stored in a compact, minimum footprint and volume. Further, sheet metal (such as aluminum or preferably painted or powder coated steel) flooring is included in the package or kit upon which the nativity figures can be placed. The flooring is made in a plurality of several identical segments to provide the nativity stable floor, and is also compact and easily shipped and stored. Further, to facilitate erection of the nativity stable on an uneven ground (and generally all lawns are somewhat uneven as they should have some slope for drainage), there are provided adjustable ground supports or legs with feet. In fact the ground supports or legs even permit up to 0 to 28 inches of adjustment for each ground engaging element or leg of the nativity stable of the present invention so that it can even be erected on a hillside up to, say a slope of 20 to 25 degrees. Further, the ground engaging legs or supports include ground engaging and pressure spreading feet portions or pads to prevent them from sinking into softer ground, mud or snow. The fact the nativity stable is made of tubing, such as steel, it has considerable weight so that it is not likely to shift or be blown over in the wind, but yet is light enough to be easily shipped, erected and/or moved into place. To further assure against movement by the wind, ground engaging hook means can be included to anchor the stable and its legs to the ground, the legs having an opening to receive the hook.

While tubular elements form the support structure for the walls, floor and roof, the latter are covered with artistic panels or coverings to provide the illusion of how a nativity stable might look at the time of Jesus' birth. To facilitate shipment and storage, these panels are flexible and may be folded, or preferably rolled up, together to minimize space requirements in the package and to prevent creasing. These panels may have grommets therein and be held to the tubular or other structural portions of the nativity stable of the present invention by releasable, reusable straps such as nylon electrical ties of such type.

Now as the nativity stables to be built come in different sizes to accommodate different size figures as noted above, they are all constructed using the same connecting fittings or fitments, but the lengths of straight sections of tubing between the fittings or fitments or bends therein are altered or extended to provide the different sizes of nativity stables. If needed for support on the even larger sizes, additional structural elements using the same fitments and tubular pieces may be provided to span the greater or additional distances on larger size nativity stables. However, the principal fitments remain the same so that there is great manufacturing economy of making a larger number of the same fitments and to provide them for all the size nativity stables by just increasing the lengths of the straight sections or sections between the fitments (or bends).

Using the present invention one could move from one size of large nativity figures to a different (usually larger) size, but yet reuse much of the prior nativity stable's fitments, and need only a minimum number of new pieces and different (or larger size) artistic panels forming or covering the walls and roof. Optionally, an artistic floor panel could also be provided to cover the floor so that the user need not even obtain additional straw or hay.

BRIEF DESCRIPTION OF THE DRAWINGS

FIG. 5A is an enlarged perspective view of a corner and two way (90° horizontal) connector for the structure and the kit of the present invention.

FIG. 5B is an enlarged perspective view of a "T" and (leg and 180° horizontal) three way connector for the structure and the kit of the present invention.

FIG. 10 is a parts list for the Kit "A" of the first embodiment of the nativity stable structure shown in FIG. 1A.

FIG. 11 is a parts list for the accessory Kit "B" of the added front section to provide when combined with Kit "A" the second embodiment of the nativity stable structure shown in FIGS. 9 and 17.

DESCRIPTION OF THE PREFERRED EMBODIMENTS

Figure 1A:
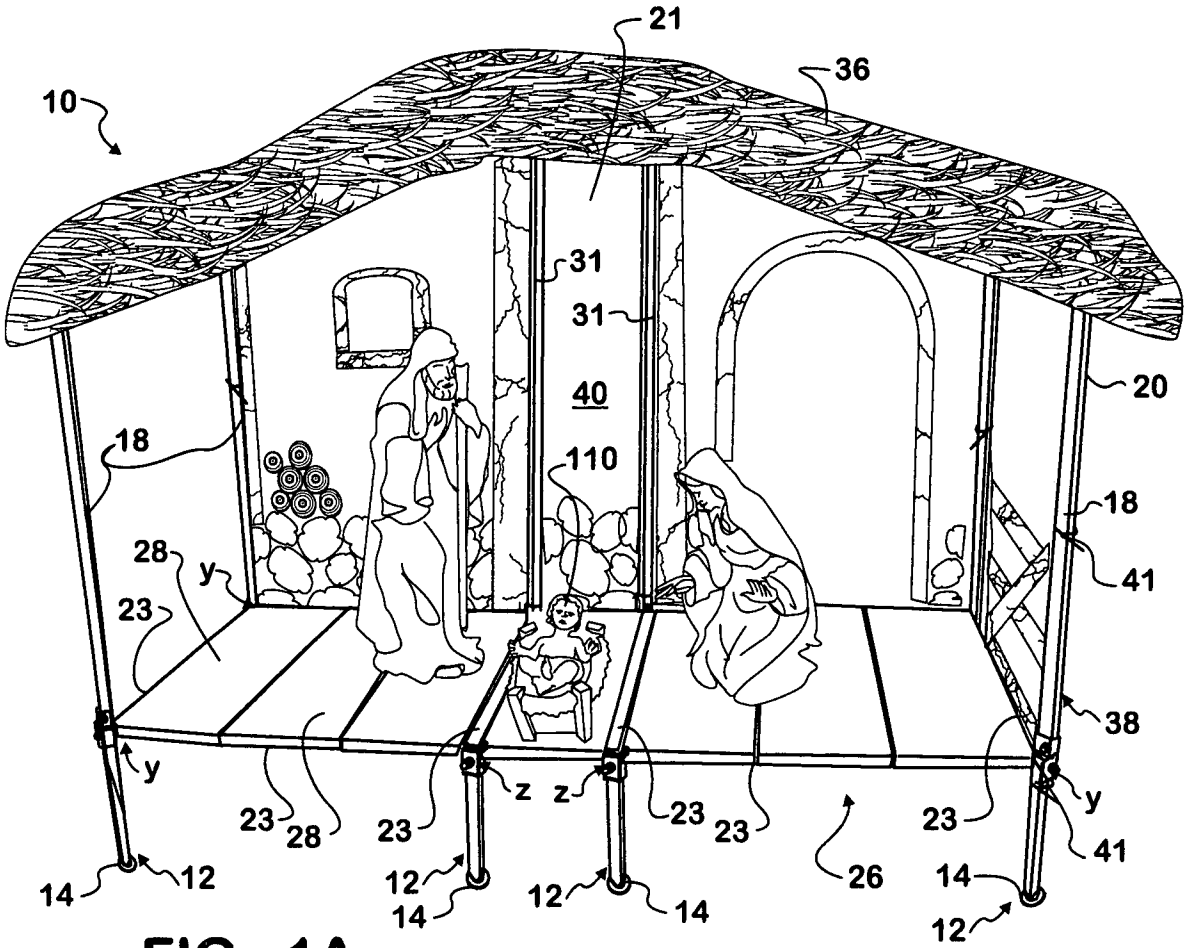
FIG. 1A is a perspective view of a first embodiment of the nativity stable structure made from a kit "A" for same and made in accordance with the teachings of the present invention.

Referring now to the drawings in greater detail, there is illustrated in FIG. 1A a first embodiment of the nativity stable structure 10 built from an "A" kit 11 (FIG. 2A) for same, made in accordance with the teachings of the present invention. The kit comes in a shipping container which will later function as a storage container or carton and is show in FIGS. 2B and 2C. the contents and components of the kit are laid out in FIG. 2A.

Figure 1B:
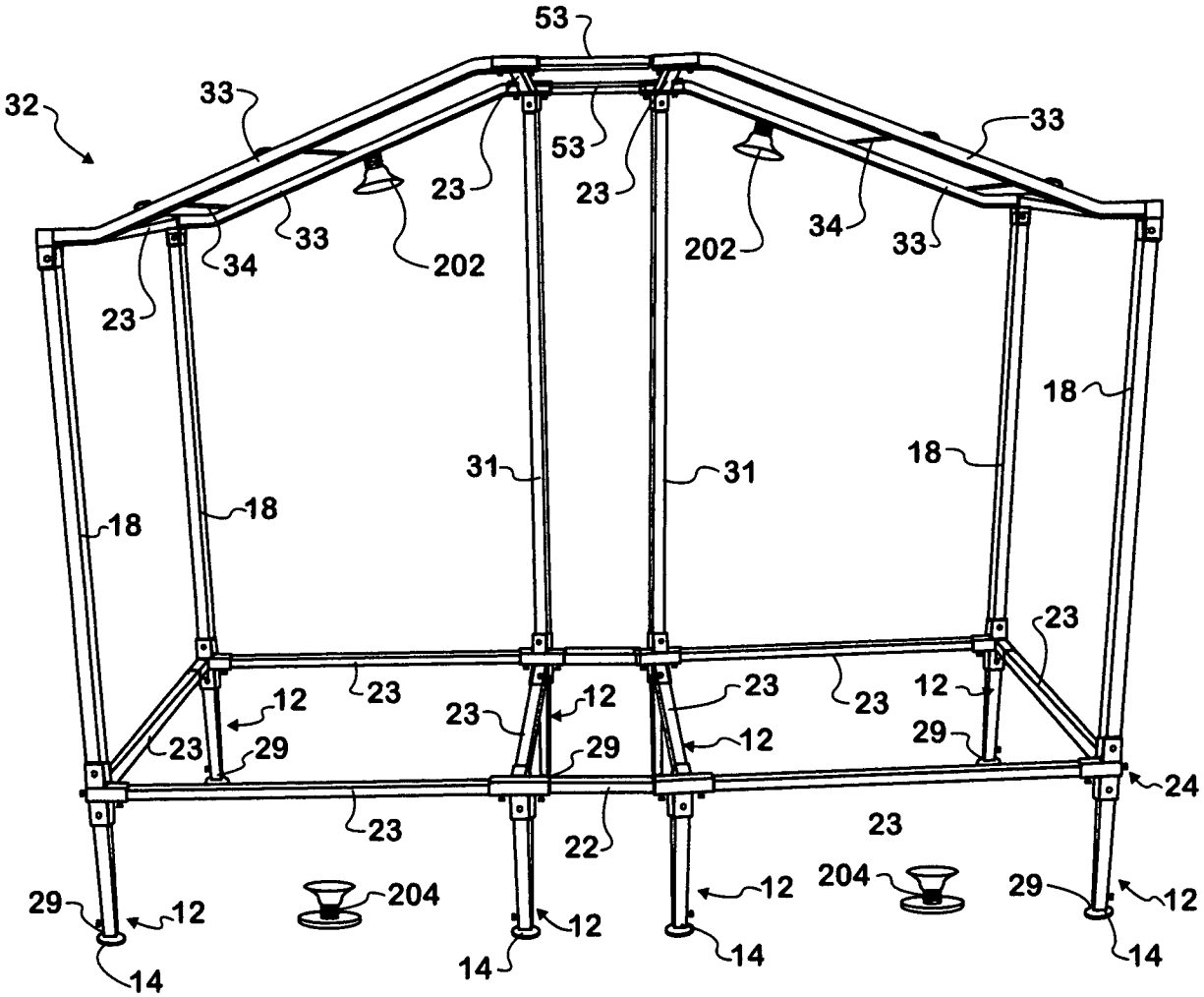
FIG. 1B is a perspective view of the bare framework of the nativity stable structure of FIG. 1A without rear or side panels, roof cover, floor panels or figures associated therewith being shown.
Figure 3:
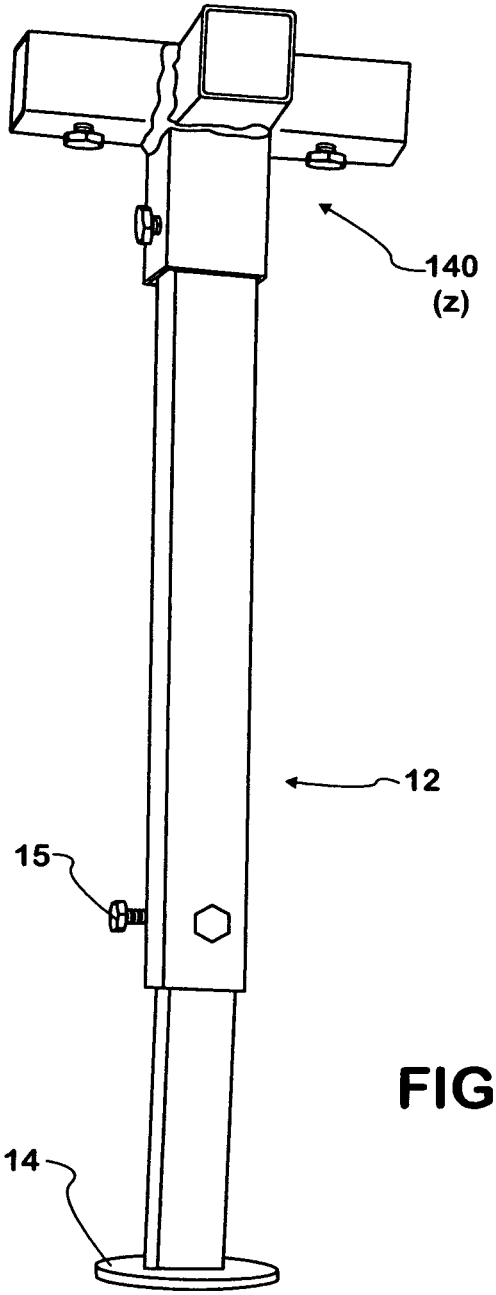
FIG. 3 is a perspective view of one built up leg of the nativity stable structure, showing same to be telescopic and having a circular pad on a bottom edge thereof which distributes the weight of the structure across a larger surface area, and showing a mid back horizontal or T-connector of the kit engaged on the top of the leg.

As shown in FIG. 1B, the "A" kit 11 for creating the nativity stable structure 10 comprises a plurality of front center telescopic support legs 12 (for example see FIG. 3) having circular bottom pads 14 on ground terminal ends thereof. The legs 12 are telescopic (in two parts) to accommodate placement of the structure 10 on an uneven surface, such as the ground, while allowing the structure to be assembled level, which legs 12 through the use of various embodiments of fittings, fitments or connectors to be described individually hereinafter, are engaged to horizontal elements or tubes 22 which extend horizontally between the inner legs 12 and horizontal elements or tubes 23 extending laterally of the inner legs 12 to outer legs 29 to create the front end of a support framework 24. The framework 24 will engage and hold a floor 26 of the nativity stable structure 10 positioned level above-ground. The floor 26 is comprised of a plurality of panels 26, preferably made of steel, and extending front to back across the framework 24. Corner and back legs 29 are adjustable in length from the floor to the ground. Corner uprights or tubes 18 are of a fixed height from the floor to the roof and are engaged to extend vertically from corner legs 29 to form the frame adjacent stable side walls 20 and a stable rear wall 21 of the nativity stable structure 10 and include taller center back vertical uprights or tubes 31. The desired height of the telescoping legs 12 is maintained through use of a frictional set screws 15, preferably one on each leg. Of course, other type adjustments or fasteners would be used.

The vertically extending corner uprights or tubes 18 engage at their top ends 30 to a framework 32 for a covered roof of the kit 11, to be described in further detail hereinafter. Extending front to back between front and back offset roof supports 33 (FIGS. 1B and 6) of the roof framework 32 are a plurality of thinner, in this instance solid, rods 34 (FIGS. 1B, 2A, 4A and 4B) which engage front to back between supports 33 thereof (FIGS. 1B and 4A) to assist in supporting a roof panel or cover 36 of the kit 11. Also included are at least one side panel 38 and a rear panel 40 which engage to the vertical uprights and between the horizontal bottom and horizontal top tubes 23, which panels 38 and 40 are preferably printed or painted or otherwise decorated, as shown, or in a similar manner, to visualize the interior of a manger or nativity stable. The panels could also be decorated to illustrate the exterior of the stable. The roof panel or cover 36 may also be printed, decorated or painted to illustrate or give the illusion of hay or straw as shown, or other roofing if desired, further aiding in visualization of a manger or nativity stable structure 10 created from the kit 11. A floor covering could also be provided and decorated to simulate hay or straw.

Figure 6:
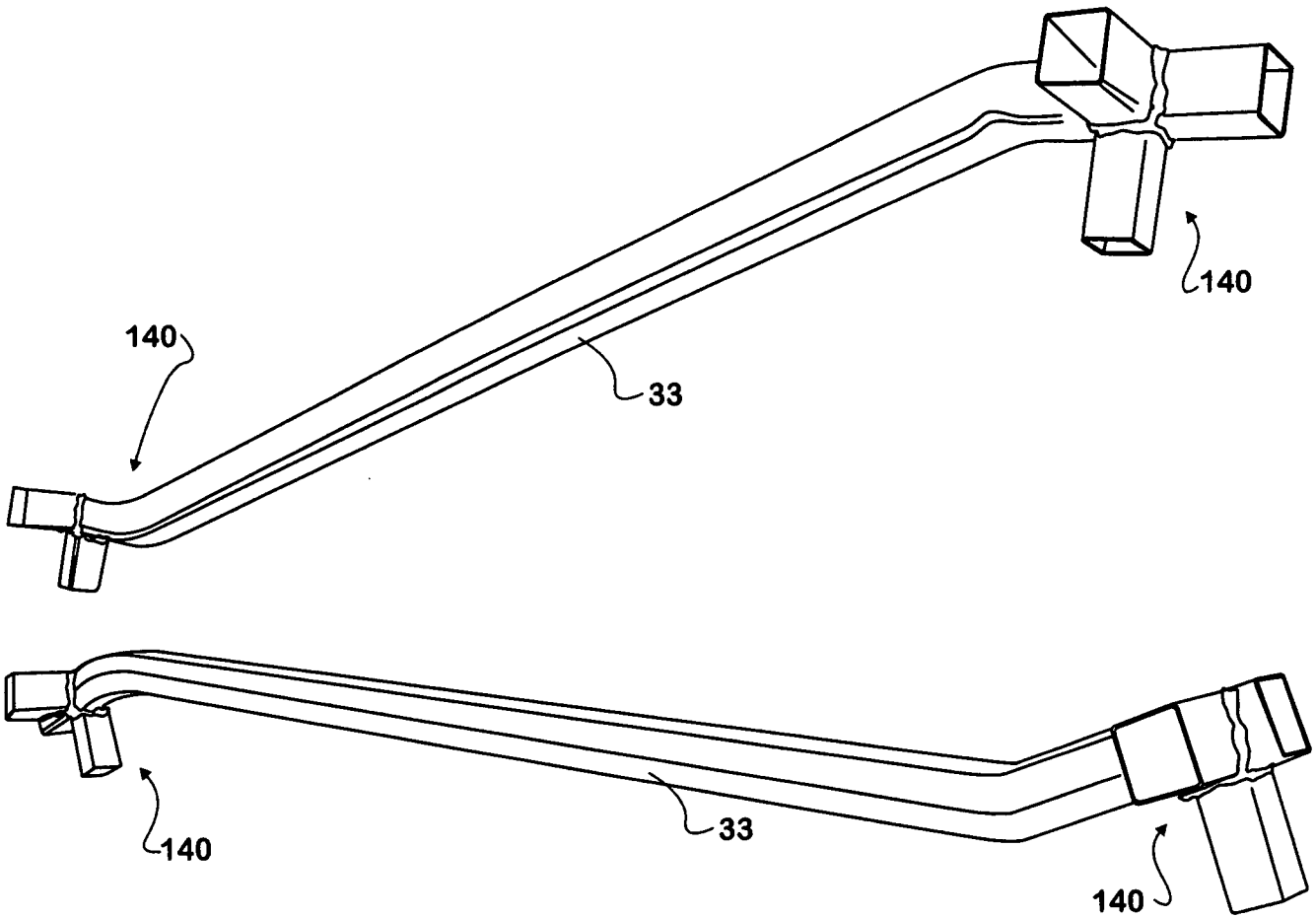
FIG. 6 is an enlarged perspective view of a pair of offset roof supports for the center rafter of FIG. 4 for the structure and the kit.

It will be seen in FIG. 6 that the offset roof supports 33 each include an elongate body portion and include at each end thereof a unitary "T"-connector, or corner connectors, with each terminal end of each support 33 being bent in a direction opposite the opposed end, at a particular angle of about 20 to 25 degrees, with about 22 degrees being preferred, to create a raised center section 42 to the roof framework 32.

As shown, a plurality of statues or figures 50 commonly found in a nativity scene are supported on the floor 26, at a position above ground level, and, with the roof cover 36, side panel 38 and rear panel 40 in position, are substantially protected from the weather conditions or weather elements, such as rain, sleet, snow and sunlight, which are harmful to the color, integrity and longevity of the useful life of the figures 50.

Figure 2A:
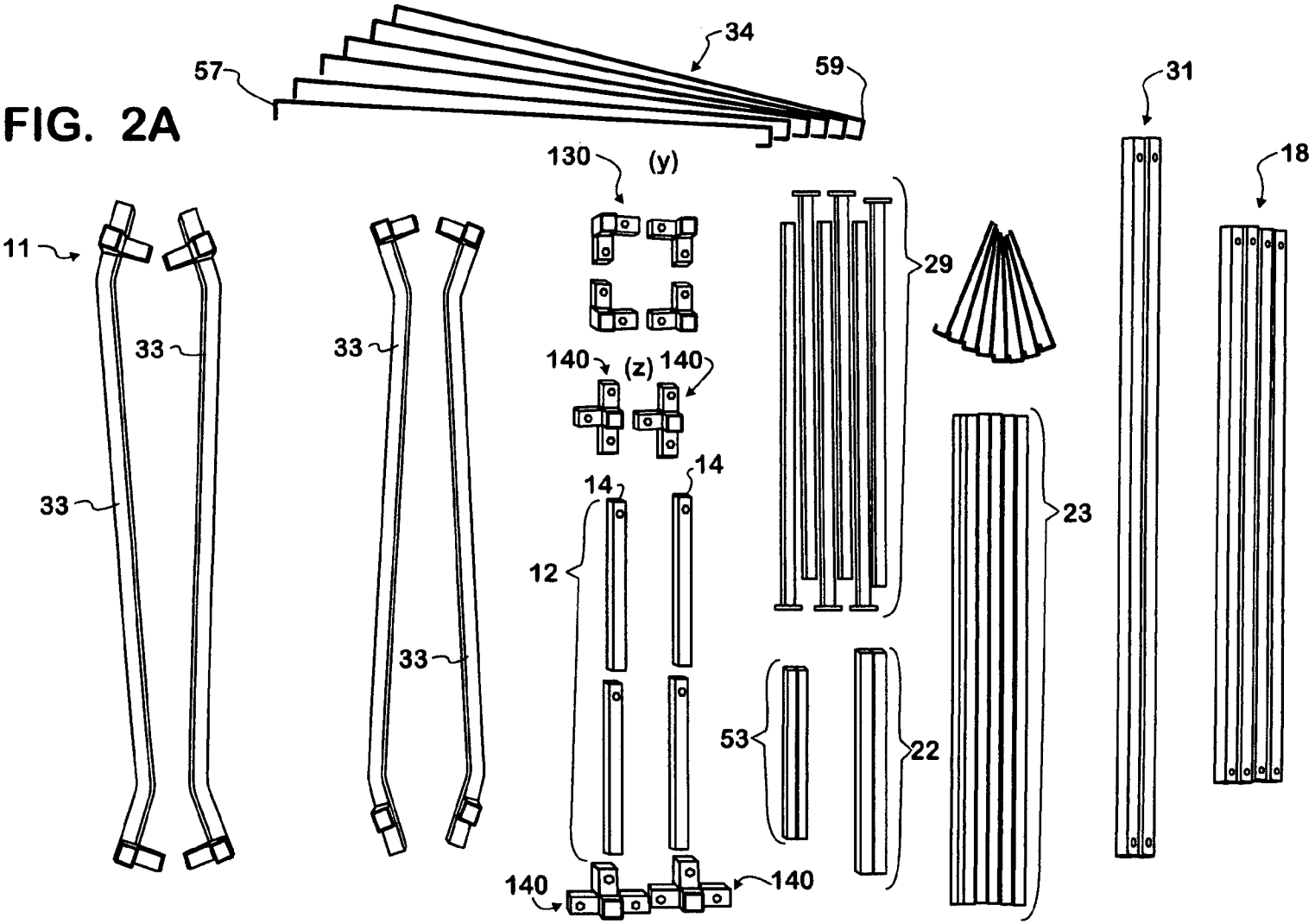
FIG. 2A is a perspective view of all the pieces of the "A" kit for creating the primary or first embodiment of the nativity stable structure of FIG. 1A.
Figure 4A:
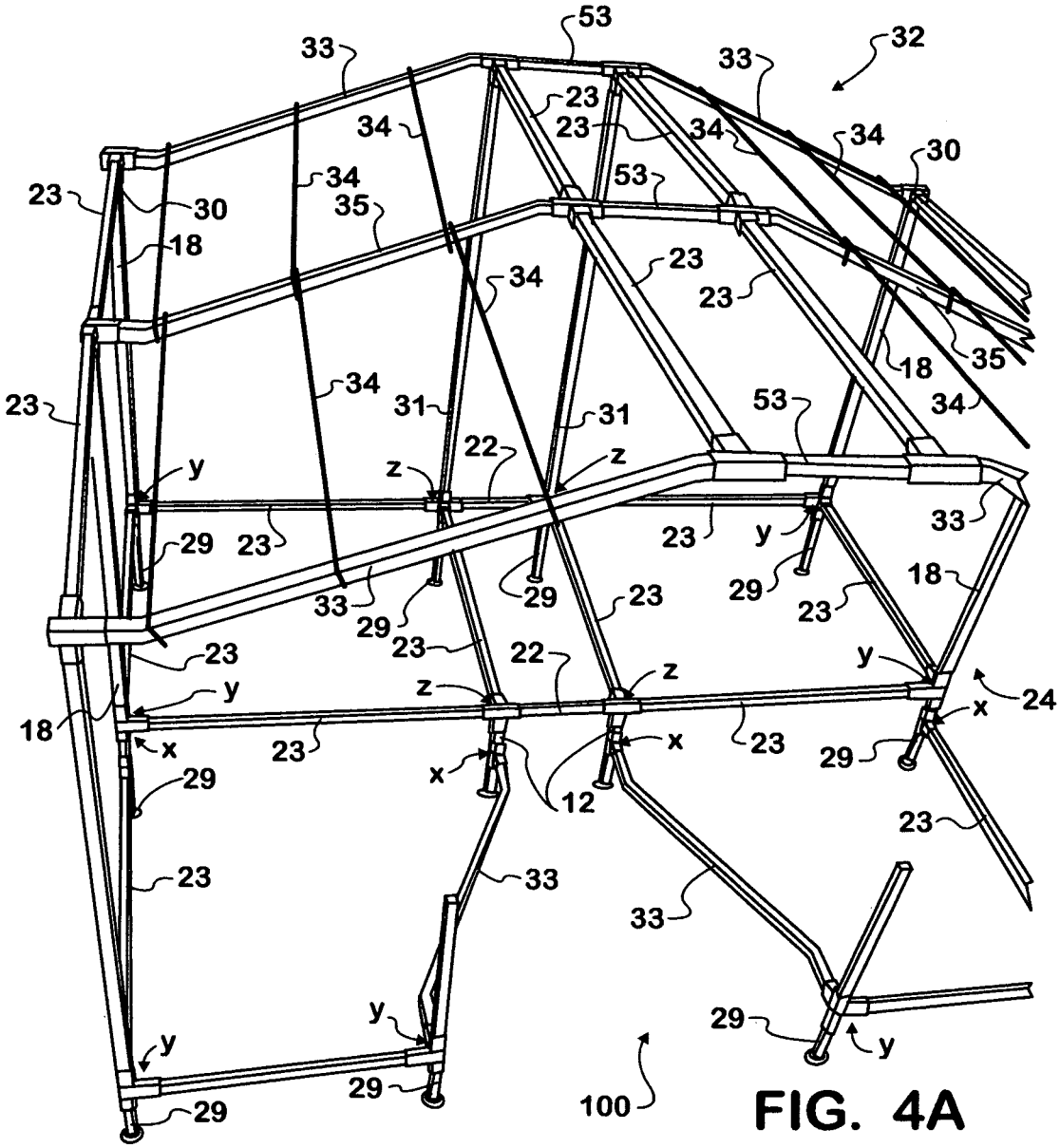
FIG. 4A is a perspective view of the second combined embodiment structure of the nativity stable structure showing the combination of an "A" kit structure with an accessory "B" kit structure, which "B" kit comprises two offset lower platform frame sides used to create a lower level at the front of the nativity stable structure, for the combined second embodiment of the nativity stable structure but without any floor panels, rear panel, side panel or roof cover thereon.
Figure 4B:
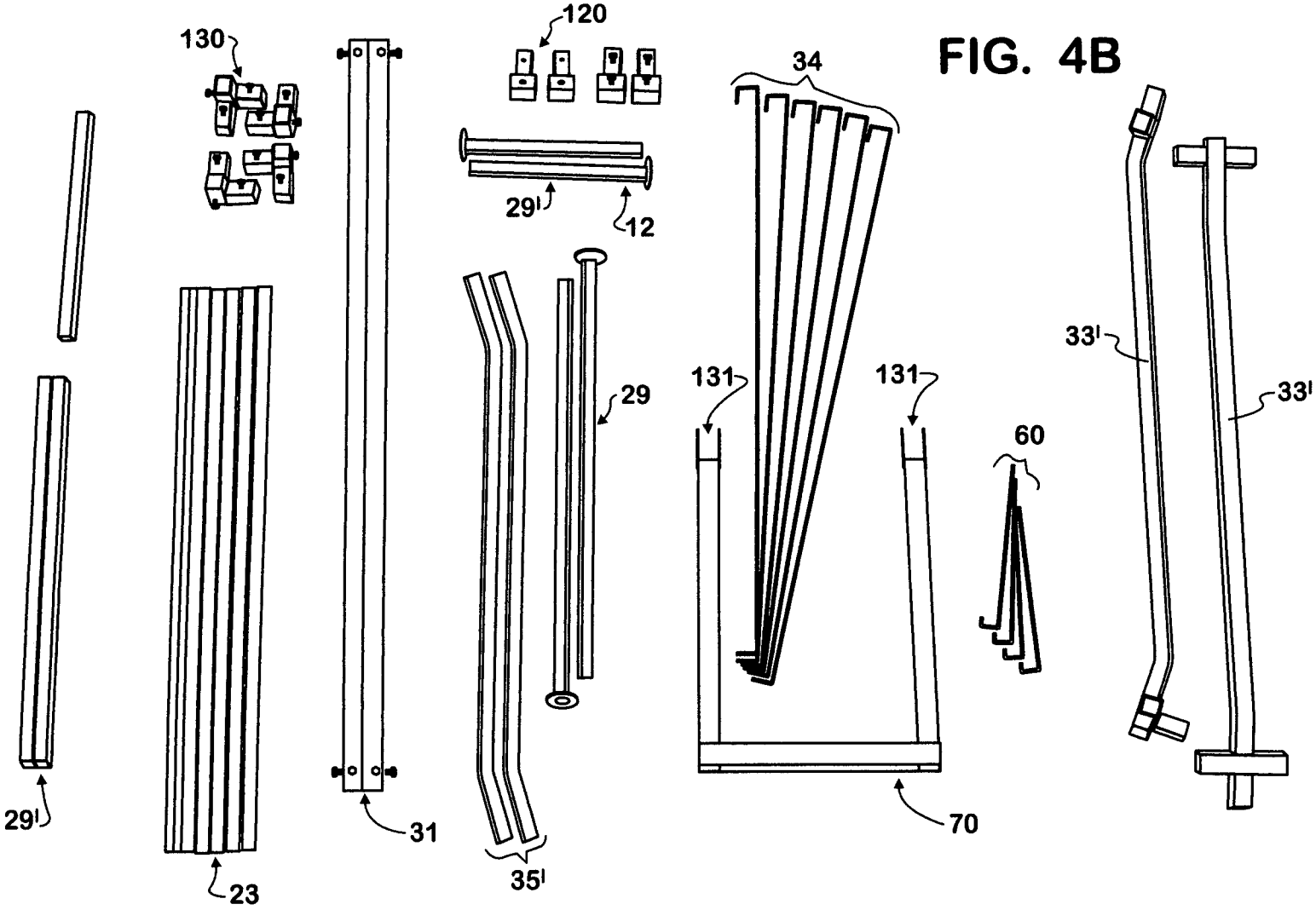
FIG. 4B is a perspective view of all the pieces of the accessory "B" kit for creating the front portion of the second embodiment for engagement to the nativity stable structure of FIG. 1A, as illustrated in FIG. 4A, to create the combined second embodiment of the nativity stable structure using the Kit (A) and Accessory Kit (B).

The framework of the nativity stable structure, whether for Kit "A" or Kit "B" is created of hollow, square (preferred) or rectangular in cross section tubing, with a plurality of parts, as listed in FIGS. 10 and 11. Parts for the first embodiment of the nativity stable structure 10 and "A" kit 11 for same, is illustrated in FIGS. 1A and 2A. Plurality of parts as listed in FIG. 11, for the additional accessory "B" kit 99 to form the second embodiment of the nativity stable structure with Kits "A" and "B" combined, is illustrated in FIGS. 4A and 4B, to create the frameworks 24, 32 for the second combined embodiment of the nativity stable structures shown in FIG. 17.

Turning back to the first embodiment 10 made from "A" kit 11, once the framework 24 is created, the side panel 38 and rear panel 40 are suitably engaged in proper positions and the roof panel or cover 36 is positioned over the framework 24, 32, as shown in FIG. 1A, to finalize the nativity stable structure 10 within which the nativity figures 50 are placed and protected from detrimental environmental conditions.

Turning now to a more detailed examination of the roof framework 32, it will be seen to comprise a pair of front offset roof supports 33 and a pair of cooperating and identical rear offset roof supports 33 as described above and wherein the pair of front roof supports 33 and the pair of rear roof supports 33 have the two separate roof supports 33 thereof joined together in the center by a short section of tubing 53 extending horizontally there between and by cross tubes 23 extending front to back between the center portions to maintain structural integrity of the roof framework 32. It will be seen that two center rear vertical support rods 31 of the kit 11 are of a greater length dimension than the corner vertical support rods 18. The center vertical support rods 31 are longer in length to allow for engagement thereto of one end of each of the two rear offset roof supports 33 which are of a particular configuration, each with ends thereof bent at a specific angle, described earlier, away from each other along the length of a support 33, and being identical to one another. The front offset roof supports 33 are then engaged to the rear offset roof supports 33 by cross members 23 which extending forwardly from the joined center rear vertical support rods 33 to engage the front offset roof support rods 33 at one end thereof, with the other end thereof engaging a top end of a corner vertical support rod 18 of the framework 24. Such engagements are created by providing each end of each offset roof support rod with a horizontal "T"-connector thereon which is used to engage the required structures for support of the roof framework 32 as defined above.

Figure 16A:
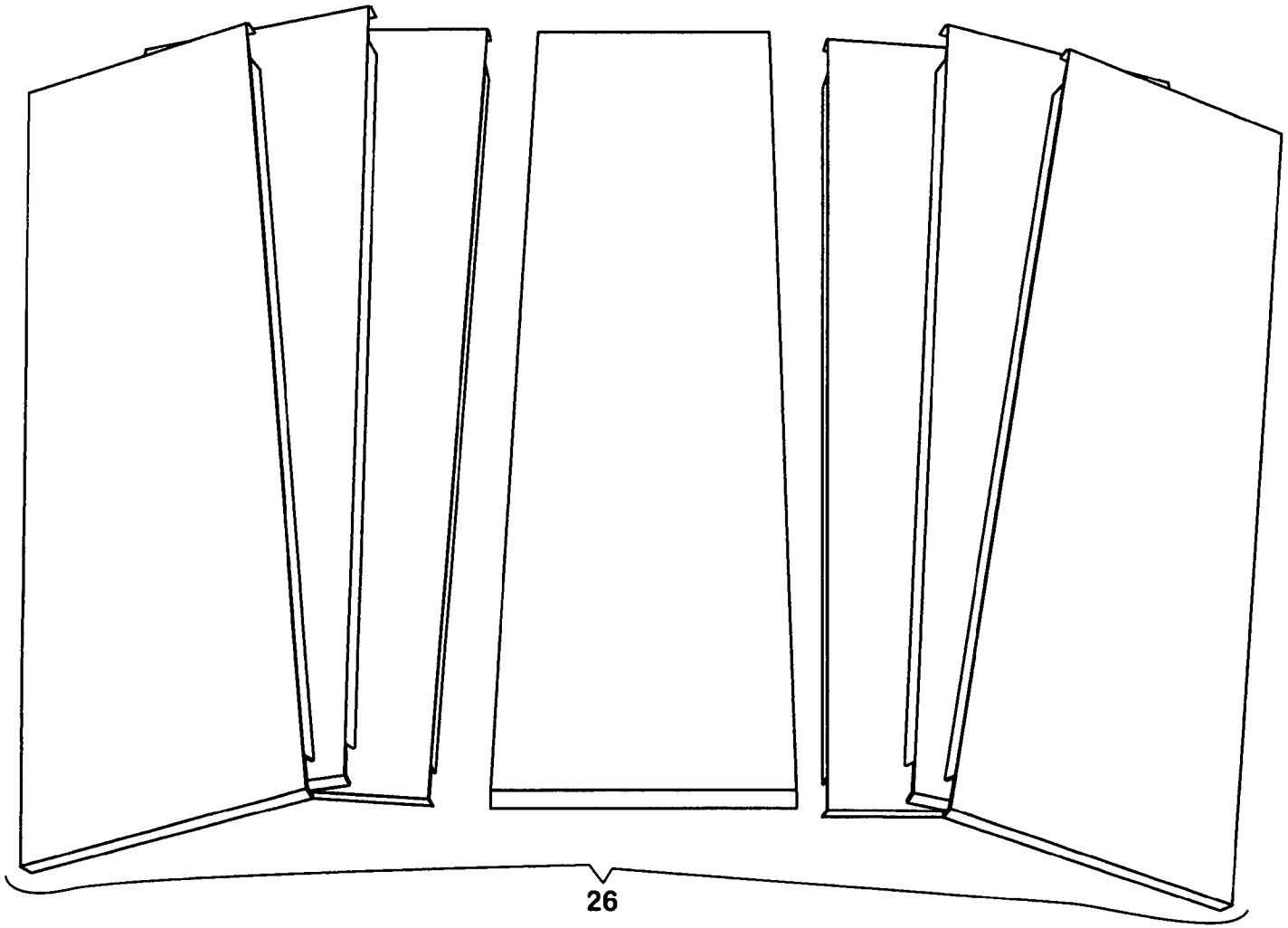
FIG. 16A shows the floor panels of the "A" kit.

Once the framework for the floor 26 has been set up, prior to build up of the entire structure, the framework 24 is leveled by adjusting the length of the plurality legs 12 and 29 until a level (not shown) shows the framework 24 to be level over the supporting surface, in most cases, the ground. Then the panels 26 (shown in FIG. 16A) forming the floor 26 are engaged to and over the horizontal rods 22, 23 extending between all the legs 12, 29 horizontally, as shown.

In a preferred embodiment, seven panels 26 are used to create the sheet metal floor 26, extending front to back across the extent of the framework 24, and such panels 26 are engaged over and to the bottom horizontal framework pieces 22, 23 to maintain the same steady. In a preferred embodiment, each panel 26 includes a cutout 28 in each end edge of a perpendicular peripheral flap 31 shown in FIG. 16C. A center panel 26 of the floor 26 is sized and configured to fit between horizontal front to back support rods 23 of the framework 24, each engaging a center leg 12 to a corresponding rear center leg 29.

Figure 14:
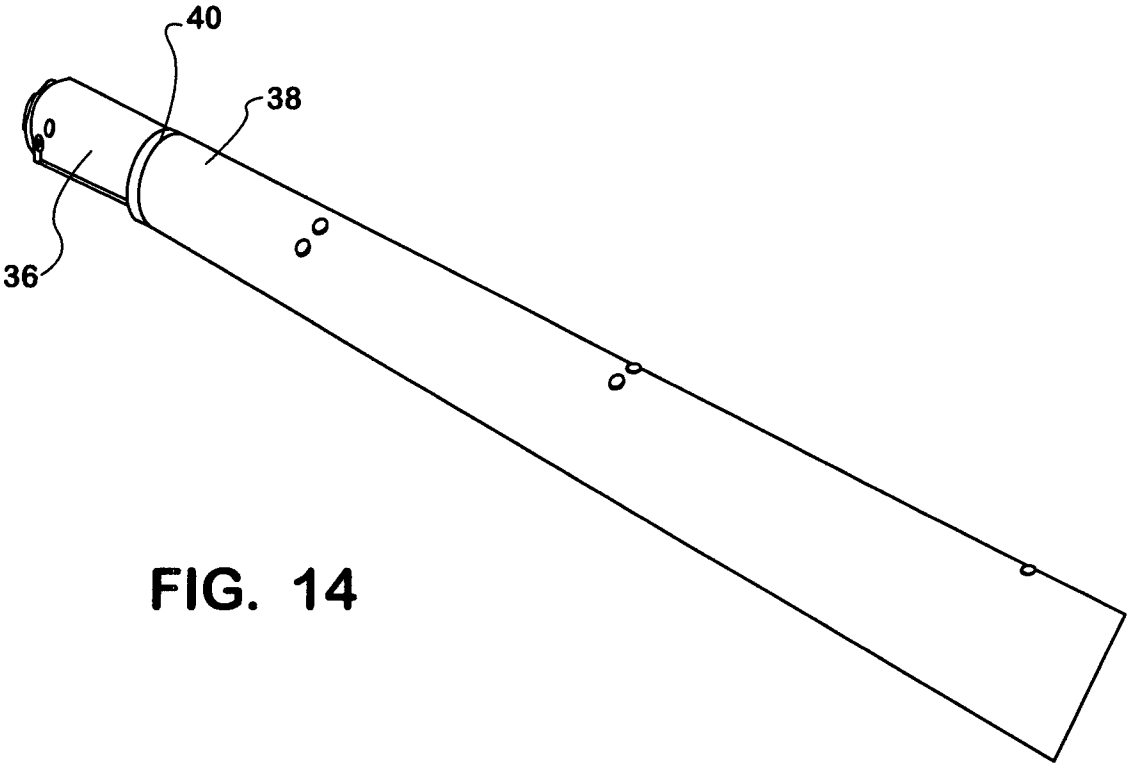
FIG. 14 is a perspective view showing a side panel, rear panel and roof panel of the "A" kit and/or accessory "B" kit, all rolled together for storage, to prevent creasing thereof.

Once the floor 26 is leveled and the remainder of the framework 24, 32 is created as described above, the decorated side panel 38 and the rear panel 40 are engaged to the framework 24 by suitable means, such as releasable electrical ties 41 shown in FIG. 1A. When not in use, the panels 36, 38 and 40 are rolled together for storage, to prevent creasing of same, as shown in FIG. 14.

Next, the plurality of thin, solid cross rods 34 are engaged across the roof framework 32, front to back, to create more support for the roof cover or panel 36. Such additional support is useful in helping to carry any snow load which may occur. These thin rods 34 include a downward, perpendicular flap 57 at one end thereof and a "c" shaped flap 59 at the other end thereof, with the "c" shaped flap 59 engaging over and around one of the offset roof support rods 33 and the other end engaging over the opposite offset roof support rod 33. Alternatively, both ends of thin rods 34 could include a perpendicular flap 57.

Once these support rods 34 are placed, the roof cover or panel 36 is then positioned over the roof framework 32 and the floor panels 26 are positioned within the framework 24, creating the nativity stable structure 10 as illustrated in FIG. 1A. If extra securement of the structure 10 to the supporting substrate is desired, ground engaging securement hooks 60 are provided to engage the framework 24 to the substrate or ground.

Figure 9:
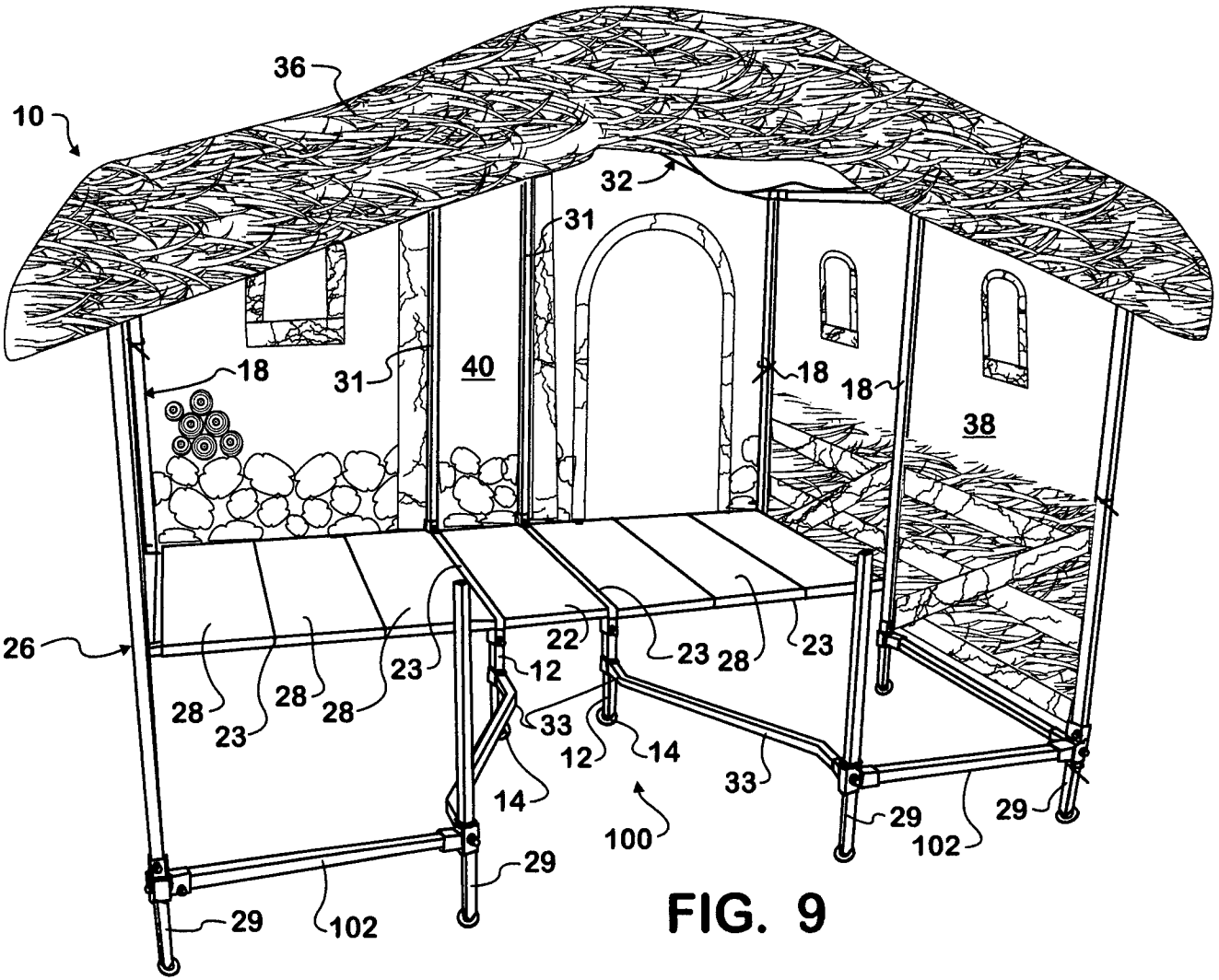
FIG. 9 is a perspective view of a combined second embodiment of the nativity stable structure and shows Kit "A" and accessory Kit "B" of the present invention, showing the nativity stable structure to include the lower level (partially built in FIG. 4A and completed in FIG. 17) at the front of the nativity stable structure, but without the floor panels of Kit "B" being engaged yet.
Figure 17:
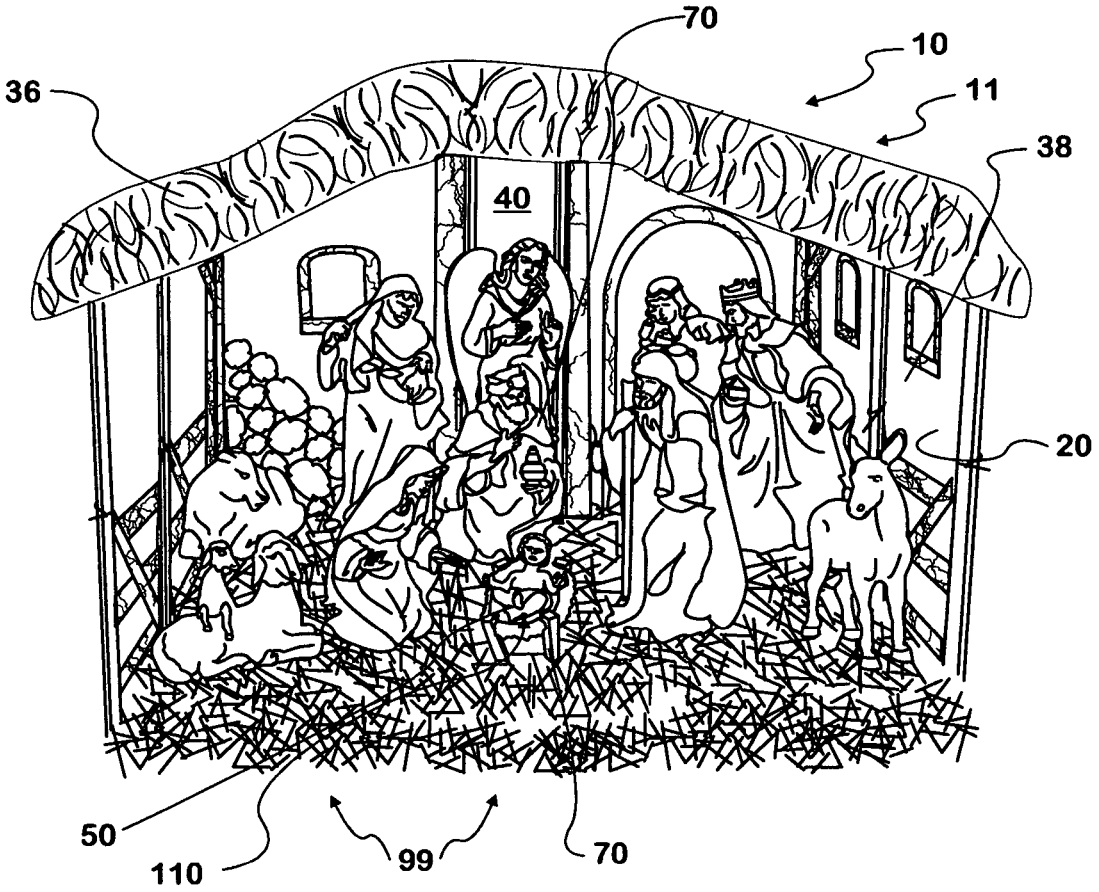
FIG. 17 shows the combined nativity stable built with kits "A" and "B" and two accessory platforms, one for an angel and the other for the baby Jesus.

Turning now to a second embodiment see FIGS. 4A, 9 and 17 of the combined nativity stable structure 10, a second front portion is built from "B" kit 99 (see FIGS. 4B and 11) which can be added to the first embodiment built with "A" kit 11. Also provided in "B" kit 99 is an accessory platform 70 which supports an accessory panel 125 thereon, the panel including depending side flanges 127 thereon which secure it over the platform 70, and with the platform 70 having a forward end raised flange 129 which maintains the panel 125 from sliding forwardly, off the platform 70.

Figure 12:
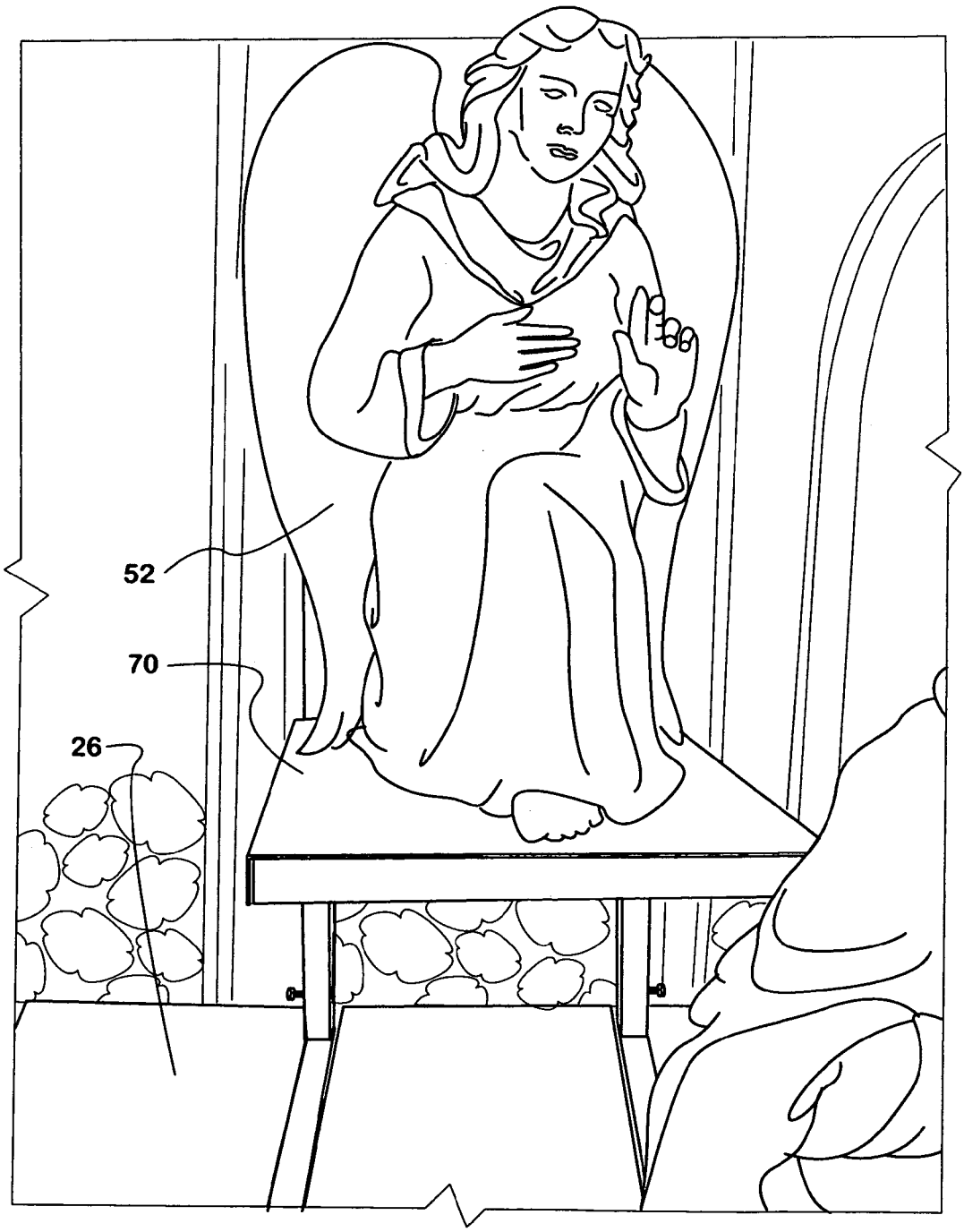
FIG. 12 is a perspective view of an accessory platform attached to rear center uprights and showing an angel statue perched thereon, above the level of the floor of the nativity stable structure.
Figure 13:
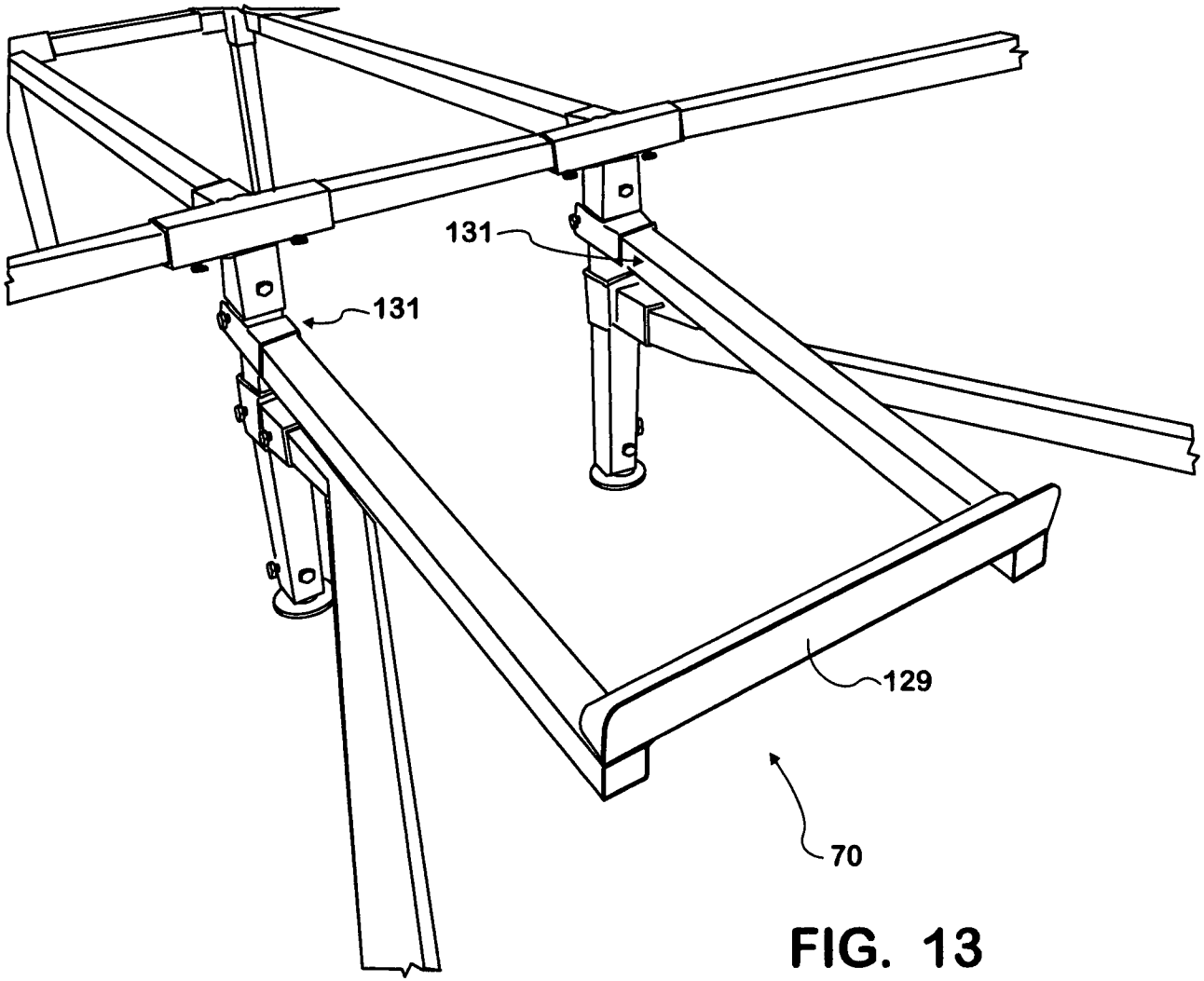
FIG. 13 is a perspective view of the same accessory platform shown in FIG. 12 but now attached to the short front supports to provide an alternative position for the Christ child or baby "Jesus" statue.

If desired, the accessory platform 70 (see FIGS. 13, 15, 16C and 17) of "B" kit 99, which is shorter in length than the floor panels 26', may be supported off the rear center vertical rods 31 at a rear end thereof, by a one way connector 120 to be defined hereinafter, and may be used to support on the top panel 25 (see FIG. 16B also) thereof, in an elevated position relative to the floor 26, an angel statue 52, as an example, as shown in FIG. 12. The height of the accessory platform 70 above that of the floor 26 may be created, as desired, by engaging a one way connector 120 unitary on each free end 131 of the "U" shaped platform 70 to each rear center vertical rod 31, frictionally, with a set screw 15.

Construction of the combined second embodiment (shown completed in FIG. 17), comprised of "A" kit 11 in combination with "B" accessory kit 99, requires partial deconstruction of the first embodiment of "A" kit 11, if previously built.

In this respect, it will be seen in a study of FIGS. 4A and 4B, that a forward, lower level framework structure 100 is provided in "B" kit 99 for the second embodiment of the nativity stable structure 10. Here it will be seen that the roof framework 32 has a forward to rear span double that of the first embodiment roof framework 32 and includes a center pair of offset roof supports 35' having unitary three way horizontal connectors 150 on each end thereof which supports 35' are otherwise identical and are interposed between the front and back framework offset roof supports 33, as were utilized in creating the framework 32 of first embodiment.

This doubled span allows for the second embodiment roof framework 32 to cover the lower level framework structure 100 extending forwardly of the front of the nativity stable structure 10 of the first embodiment In order to reconstruct the nativity stable 10 into its second embodiment, the offset roof support 33 on the front of the "A" kit 11 structure 10 must be removed and replaced by the center pair of offset roof supports 35' of "B" kit 99.

Next it will be seen that one of another shorter pair of roof forming offset rods 35' having identically bent ends to those of rods 35, is engaged to and extends forwardly of each of the two center feet 12 of the nativity stable structure 10, at a height below that of the floor 26 of the nativity stable structure 10 and engages a forward leg 29, in a manner where the legs 29 extend apart, creating a space there between.

To accomplish this addition, the front center front legs 12 must be detached from the framework and have a one way horizontal connector 120 engaged thereto, facing forward, to each of which one corresponding end of one framework section 35' must be engaged, in a manner to extend forwardly thereof when the legs 12 are reconstructed. Next the two front corner legs 29 must be disengaged for identical engagement thereto of a forward facing one way connector 120 to each, with each corner leg 29 now also being engaged to one end of a forward directed tube or rod 102, when reconstructed. Each rod 102 extends forwardly to a corner forming leg 29 engaging an upright 18 to which will be engaged one end of the front offset roof support previously removed from its engagement over the front edge of the first embodiment built from "A" kit 11. Previous front corner leg 29 and framework 24, of the first embodiment built from "A" kit 11 now become centered, front to back, within the second embodiment of the nativity stable structure 10. Next, another horizontal rod 23 is extended from the newly built forward corner 29 to the one way connector 120 of now center framework corner leg 29, also at a level below the floor 26 of the nativity stable structure 10. The opposite side is created in a mirror image manner to that just described, and creates a lower level 100 for displaying, if desired, a crèche 110, at a more visible level, closer to the ground or other supporting surface. It will be understood that each of the legs 29 of the lower level 100 may also have a pad 14 on the end thereof to spread the weight of the structure 10 over a larger surface area.

Figure 15:
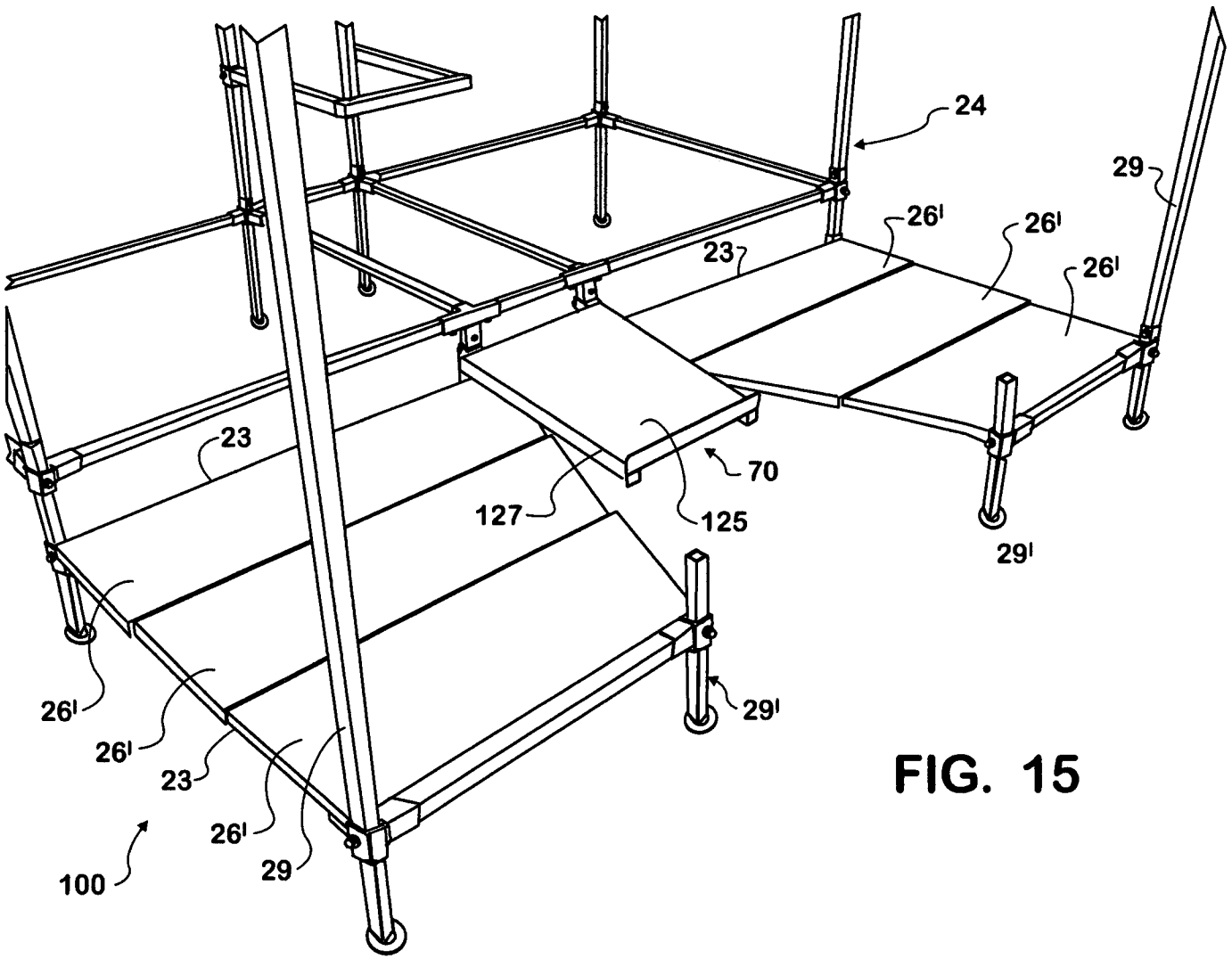
FIG. 15 shows the "B" accessory kit platform with floor panels thereof engaged thereto and shows a platform 70 engaged just above the accessory platform and having a floor panel thereof engaged there over.
Figure 16B:
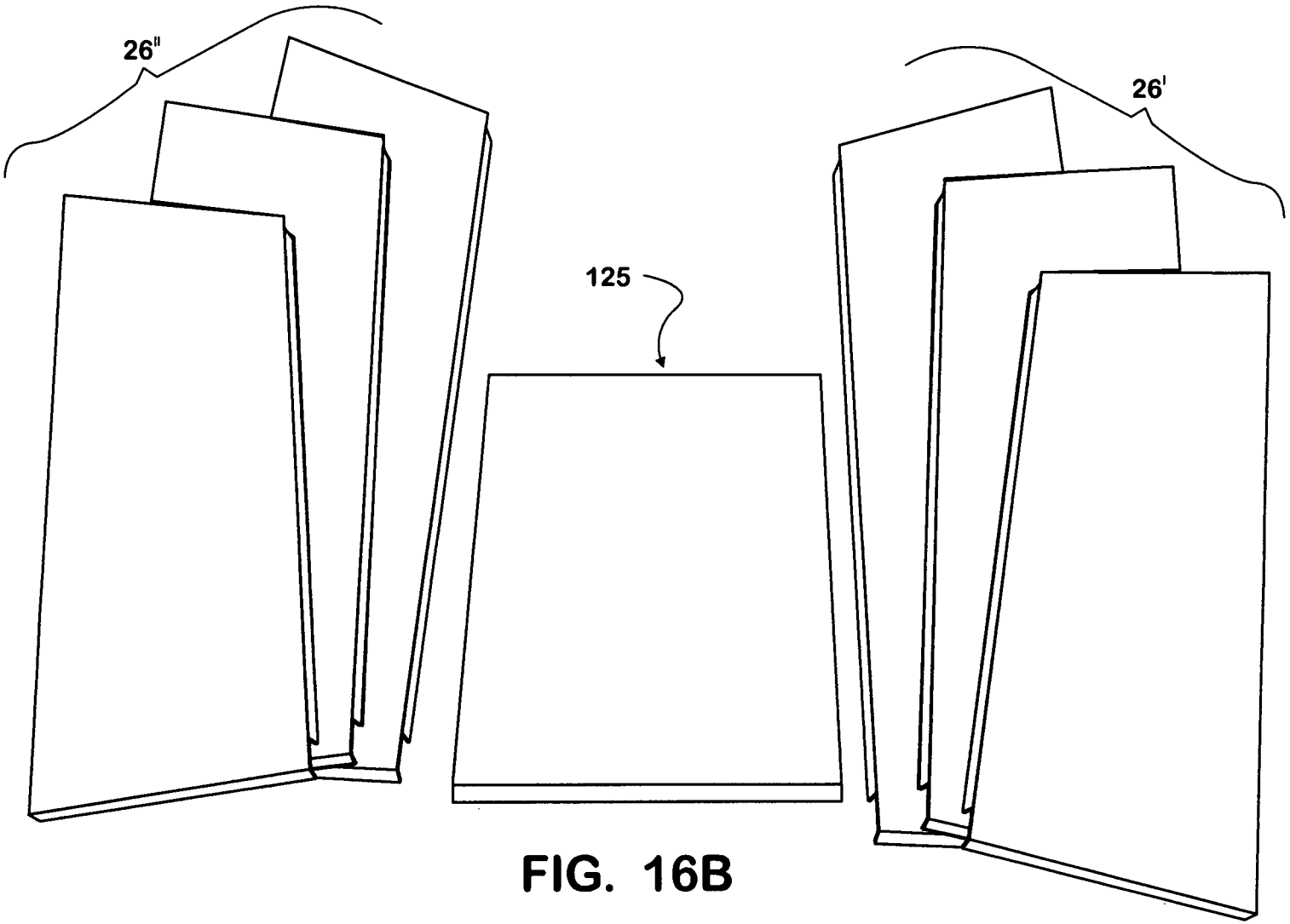
FIG. 16B shows the floor panels of the "B" kit and the floor panel of the accessory platform.
Figure 16C:
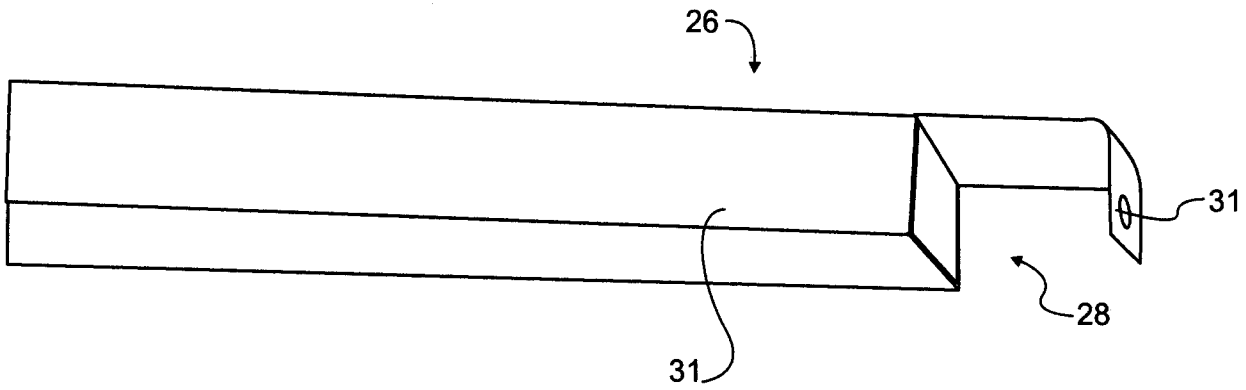
FIG. 16C shows a side view of a floor panel, showing an end track thereof which fits over horizontal bars or elements of the frameworks.

Finally, after all framework structures of the combined "A" kit 11 and accessory "B" kit 99 are engaged as defined above, cross rods 34 are again engaged front to back, between the offset support rods 33, 35 and floor panels 28 are positioned. Larger angled floor panels 26' should be positioned to either side of the center of the forward portion built from "B" kit 99, as shown in FIGS. 15 and 16B. Further, it will be seen that the platform 70 can also be engaged to extend forwardly of the center front legs 12, using one way connectors 120, to provide a centered lower level platform between the rods 35', just above their point of attachment, to provide a lower level platform 70 (see FIG. 15) to set upon a figure, such as the Christ child 50.

Figure 7:
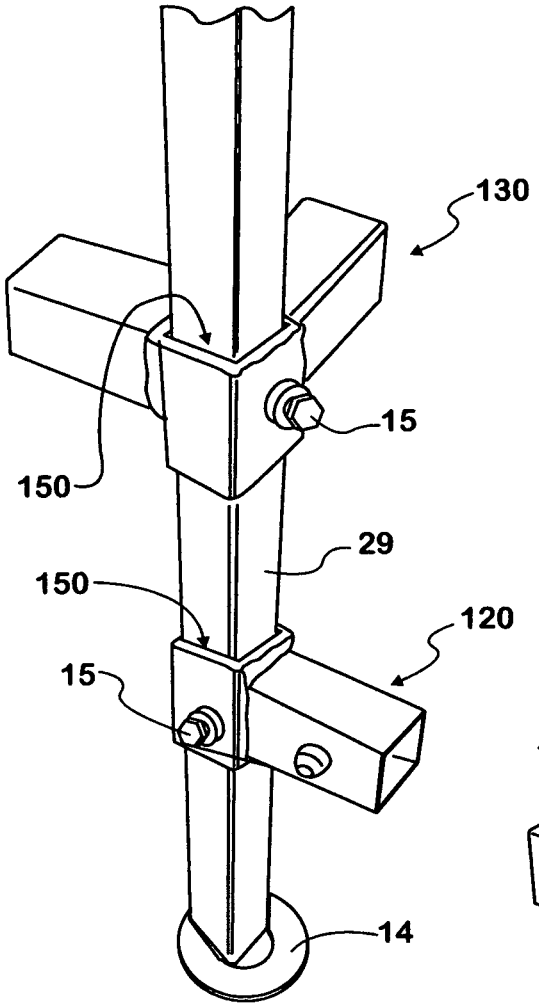
FIG. 7 is a perspective view of another built up leg of the kit showing same having engaged thereto one straight connector and one corner connector of the kit, used at front corners of the nativity stable structure of kit "A", in preparation for combination with the structure of accessory Kit "B" therewith.

It will be understood that a plurality of various embodiments of connectors are utilized to create the nativity stable structures 10 of the second embodiment formed from combined "A" and "B" kits, 11 and 99, respectively. In this respect, referring to FIG. 7, one embodiment of connector can be considered a one way or direction horizontal connector 120 (see FIG. 7), for use in, for example, connecting the forward offset bars 35' of the second embodiment built from "B" kit 99 to extend forwardly from the center legs 12 and corner legs 29 of the floor 26 at all positions "X" (in FIG. 1A). There above, engaged to the corner leg 29 of FIG. 7, is a two way or direction horizontal or corner connector 130 (also see FIGS. 5A and 7), used for engaging the leg 29 to perpendicular horizontal bars 23 used in, for example, creating a corner of the nativity stable structure 10 at all positions "Y" (in FIG. 1A), as will be understood by those skilled in the art.

Figure 8:
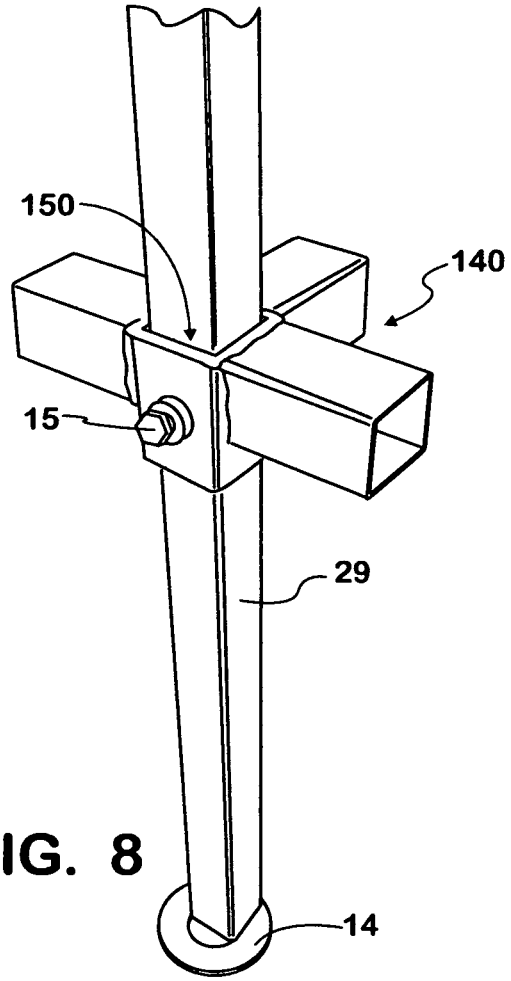
FIG. 8 is a perspective view of a built up mid back leg of the kit showing same having engaged thereto the "T"-connector of the kit.

A further connector, which may be defined as a three way horizontal or "T"-connector 140 (see FIGS. 5B and 8), is found useful for, as an example, engaging center legs 12 of the nativity stable structure 10, to horizontal bars 23 extending horizontally there from in two perpendicular directions, as well as connecting to a horizontal bar 22, along the front edge of the nativity stable, extending to the other center leg 12, at all positions "Z" (in FIG. 1A).

It will be understood that each of the connectors include a vertical hollow connector portion 150 which releasably and telescopically engages over a leg or rod, except those at the ends of the offset roof supports 33, and is positionable along the legs 12, 29 through use of frictional engaging set screw or bolt 15 which holds the desired connector to the leg 12, 29 or rod 22, 23, at a desired position there along by friction when turned against the material of the leg. Of course, other suitable type connectors for producing adjustable or frictional engagement between the telescoping parts could be used.

It will be further understood that the nativity stable structure 10 of each embodiment includes a suitably sized rear panel 40 and suitably sized side panel 38 and roof panel or cover 36 as well as the mechanically engageable structures of FIG. 2A, which shows the structures of the first embodiment built from "A" kit 11.

Figure 2B:
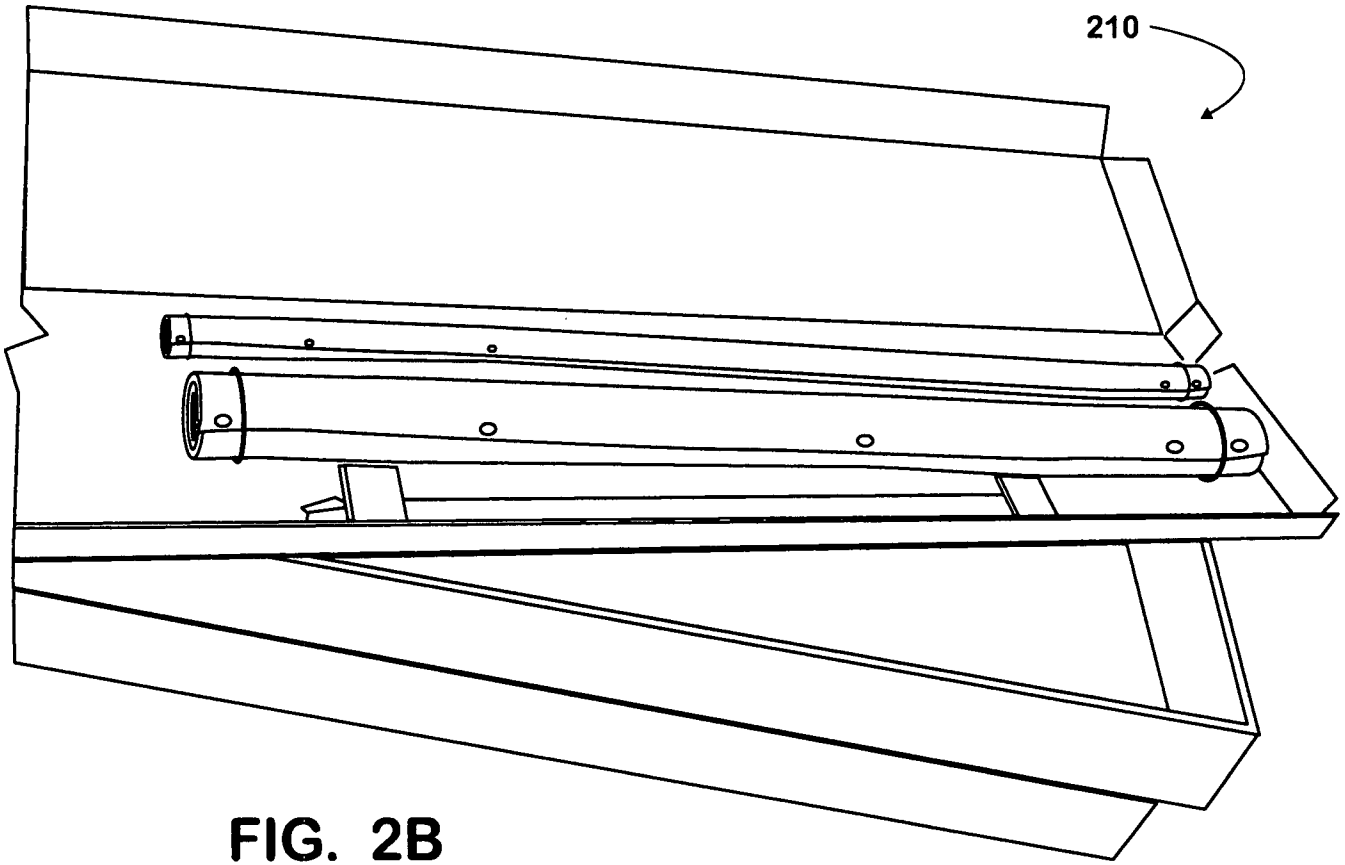
FIGS. 2B and 2C provide a perspective view of the boxes or containers within which the "A" kit are shipped or delivered and stored.
Figure 2C:
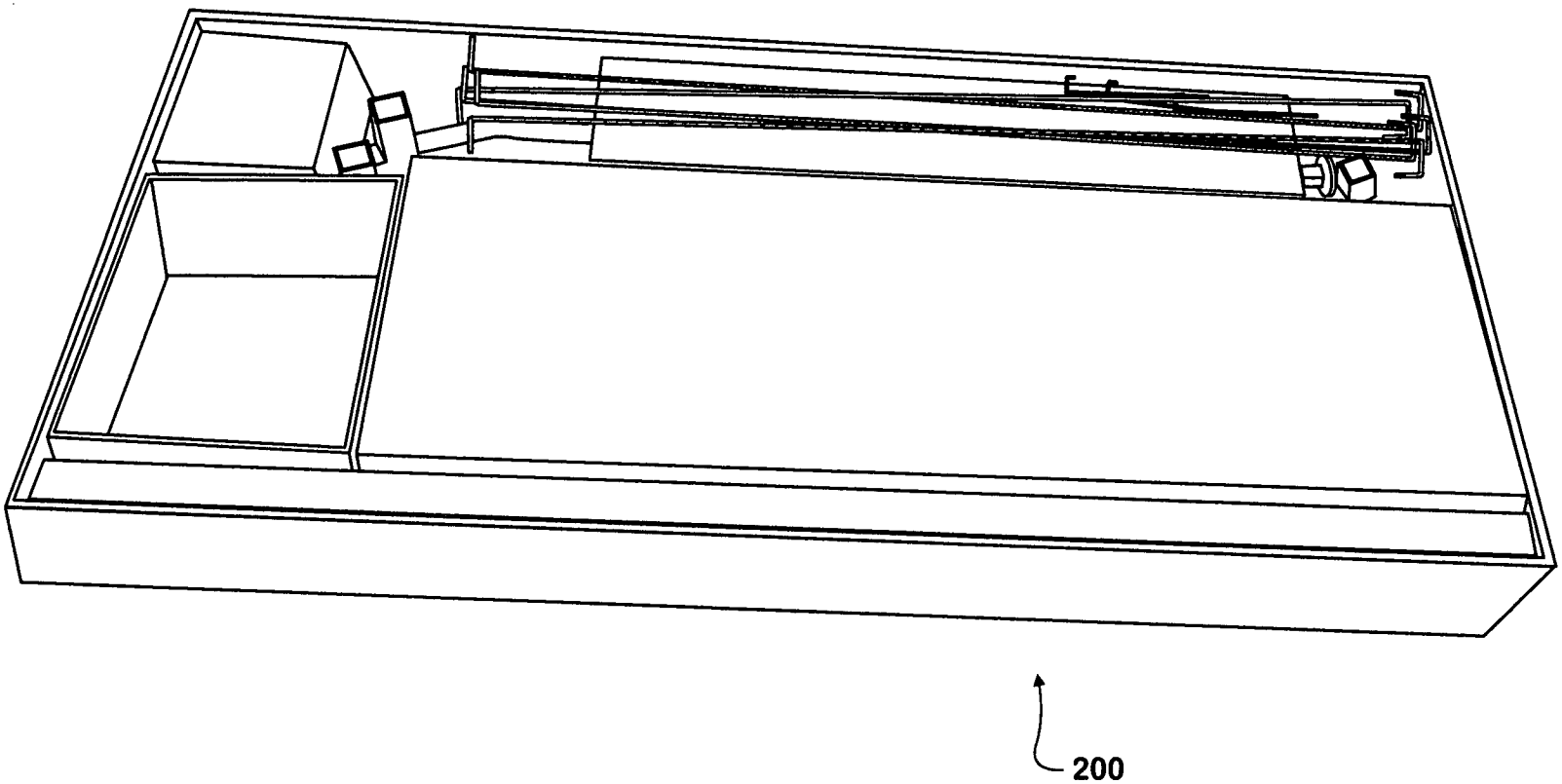

As shown in FIGS. 2B and 2C, each of the kits 11 and 99 for both embodiments of the nativity stable structure 10 comes in two boxes 200 and 210 which are suitable for shipping and subsequent use in storing the nativity stable structure(s) 10 when not displayed. In a preferred embodiment, all the heavier framework pieces are packed in box 200, and the lighter and smaller pieces are packed in box 210, with each of the boxes being compartmentalized for protection and ease of storage.

Figure 18:
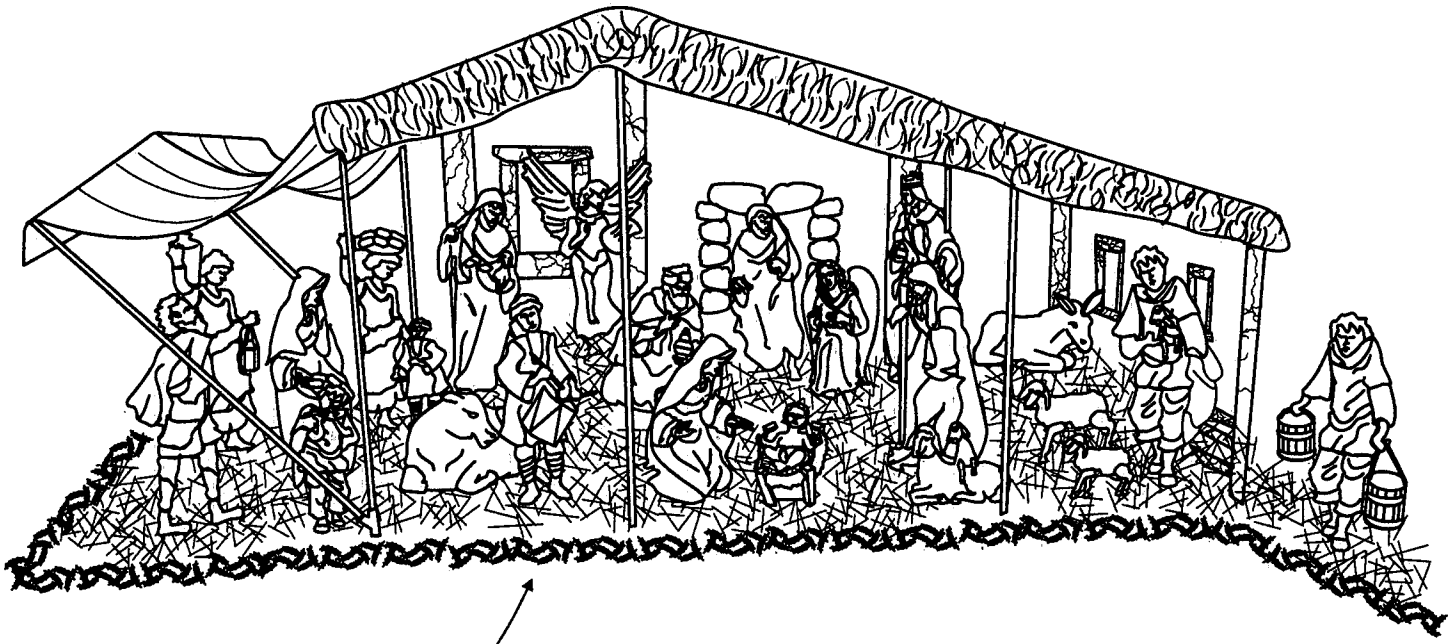
FIG. 18 shows a similar stable but wherein the stable is increased in depth (distance front to back).

FIG. 18 shows an alternative nativity booth 300 of a double depth. It should be understood that the other versions of nativity stables could also be doubled in depth.

If needed, ground hooks can be engaged to the leg and ground to hold the stable in place. Also, interior lighting 202 and/or exterior lighting 204 of low voltage, say 12 or 24 volts or less, can be provided as schematically shown in FIG. 1B mounted to the frame anchor ground.

As described above, the methods and apparatus of the present invention provide a number of advantages, some of which have been described above and others of which are inherent and/or apparent in the invention. Also, modifications may be proposed to the methods and apparatus without departing from the invention disclosed herein. While the preferred method and apparatus of the present invention have been described, it should be understood that alternative or equivalent steps and elements fall within the scope of the appended claims.

What is claimed is:

1. A kit for building a nativity stable structure for housing nativity statues and adapted to be exposed to weather conditions, comprising a plurality of legs which are adjustable to accommodate uneven substrate upon which the nativity stable structure is to be built, a plurality of uprights which support a roof framework thereupon, the roof framework comprising bent rods, and creating a roof extending from a center high to lateral lows, perpendicularly relative to a front to back dimension of the nativity stable structure, a plurality of horizontal rods engaged to and extending between one of top portions of the legs and bottom portions of the uprights, over which are engaged a plurality of floor forming panels to create a floor for the nativity stable structure to support the nativity statues at a height above the substrate, a plurality of two-way and three-way connectors for engaging the uprights, horizontal rods and legs together, at least one of a side panel and a rear panel for the nativity stable structure which are decorated to resemble the interior of a stable, and a roof cover for covering the roof framework, to protect the nativity statues placed within the nativity stable structure, on the floor thereof, from the weather conditions.

2. The kit of claim 1, wherein said kit has both a rear panel and a side panel.

3. The kit of claim 1, having at least one center rear upright which is of a length greater than corner uprights of the kit.

4. The kit of claim 3, having two center rear uprights.

5. The kit of claim 1, having at least one forward center upright which is longer than the length of the corner uprights of the kit.

6. The kit of claim 1, having solid rods which engage across roof framework front to rear to act as extra supports for the roof cover.

7. The kit of claim 1, wherein the corner uprights are approximately 1.5 times the height of a nativity statue being placed within the nativity stable structure.

8. The kit of claim 1, wherein the legs incorporate pads on bottom ends thereof of greater cross sectional area of the legs to spread the weight of the structure across a greater area.

9. The kit of claim 1, accommodating nativity statues having one of a plurality of heights, the uprights of the kit being sized to accommodate a statue of particular height.

10. The kit of claim 9, wherein the height of the statue accommodated is one of at least 12, 24, 36, 48, 60, 72 or greater inches high.

11. The kit of claim 1, wherein the legs are telescopic and adjustable in height and the uprights are fixed in height.

12. A kit as in claim 1, including accessory lighting, said accessory lighting being of a low voltage and for at least one of interior or exterior lighting of the nativity stable.

13. A nativity stable structure for housing nativity statues, comprising at least a plurality of legs which are adjustable in height to accommodate uneven substrate upon which the nativity stable structure is to be built, a plurality of uprights which support a roof framework thereupon perpendicularly relative to a front to back dimension of the nativity stable structure, a plurality of horizontal rods engaged to and extending between one of the top portions of the legs and the bottom portions of the uprights, over which are engaged a plurality of floor forming panels to create a floor for the nativity stable structure at a height above the substrate, a plurality of two way and three way connectors for engaging the uprights, horizontal rods and legs together frictionally, at least one of a side panel and a rear panel for the nativity stable structure and a roof cover for covering the roof framework, to protect the nativity statues placed within the nativity stable structure, on the floor thereof, from the weather conditions.

14. The stable structure of claim 13, wherein the at least one of a side panel and rear panel for the nativity stable structure is decorated to resemble an interior of a stable.

15. The stable structure of claim 14, wherein both said rear and side panels are provided and are decorated to resemble an interior of a stable, and said roof cover is decorated to resemble a stable roof.

16. The nativity stable structure of claim 13, wherein the roof cover overhangs a front, sides and back of the nativity stable structure and is decorated to resemble a roof of a stable.

17. An accessory kit for creating a forwardly extending accessory structure for engagement to a nativity stable structure for holding nativity statues, comprising a plurality of corner uprights for creating forwardly extended outer corners of the accessory structure, a plurality of shorter uprights positioned laterally inwardly of the corner uprights, and having an open space there between, a plurality of straight horizontal members extending from front corners of the nativity stable structure to front corners of the accessory structure, a pair of horizontal members each extending from one front corner to an inner shorter upright, and a pair of bent end rods extending from a forward center of the nativity stable structure to the shorter uprights of the accessory structure, a pair of intermediate bent end roof framework structures to be positioned to form a roof, at least one side panel and a roof cover to cover the roof of the accessory structure, and a plurality of floor forming panels for engagement across the accessory horizontal members.

18. The accessory kit of claim 17, comprising a platform which is engageable to and extendable outwardly from the front center of the nativity stable.

19. The accessory kit of claim 17, having solid rods which engage across roof framework front to rear to act as extra supports for the roof cover.

20. The accessory kit of claim 17, wherein the corner uprights are approximately 1.5 times the height of the tallest statue being supported within the nativity stable structure.

21. The accessory kit of claim 17, wherein said corner uprights and said shorter uprights are legs and incorporate pads on bottom ends thereof of greater cross sectional area than the legs to spread the weight of the accessory structure across a greater area.

22. The accessory kit of claim 17, wherein the legs are telescopic and adjustable in heights at a level below where the horizontal members are engaged.

23. The accessory kit of claim 17, wherein the at least one side panel is decorated to resemble an interior of a stable and the roof cover is decorated to resemble a roof of a stable.

24. A nativity stable structure adapted to be exposed to weather conditions, comprising a plurality of legs which are height adjustable to accommodate uneven substrate upon which the nativity stable structure is to be built, a plurality of uprights supported on said legs and which support a roof framework thereupon, the roof framework comprising bent rods extending perpendicularly relative to a front to back dimension of the nativity stable structure, a plurality of horizontal rods engaged to and extending between one of top portions of the legs and bottom portions of the uprights over which horizontal rods are engaged a plurality of floor forming panels to create a floor for the nativity stable structure at a height above the substrate, a plurality of two way and three way connectors for engaging the uprights, horizontal rods and legs together, at least one of a side panel and a rear panel for the nativity stable structure, and an accessory structure comprising a plurality of uprights for creating forwardly extended outer corners of the accessory structure, a plurality of shorter uprights positioned laterally inwardly of the uprights, and having an open space there between, a plurality of straight horizontal members extending from front corners of the nativity stable structure to front corners of the accessory structure, a pair of horizontal members each extending from one front corner to an inner shorter upright, and a pair of bent end rods extending between forward center legs of the nativity stable structure to the shorter uprights of the accessory structure, a pair of intermediate bent end roof framework structures to be positioned in a centered manner at the juncture of the nativity stable structure and accessory structure, with the front roof framework structure of the nativity stable structure becoming the front roof framework structure of the combined nativity stable and accessory structures, at least one side panel and a roof cover to cover the combined larger roof area of the nativity stable structure and accessory structure, a plurality of floor forming panels for engagement across the accessory horizontals, and a platform which is engageable to and extendable outwardly from center legs of the nativity stable structure between the bent framework horizontal portions of the accessory structure, the panels and roof cover of the combined nativity stable structure and accessory structure protecting the nativity statues placed on the floor panels of the nativity stable structure and accessory structure from the weather conditions.

25. The combined structures of claim 24, wherein a platform is engageable to and between rear center uprights of the nativity stable structure to form an elevated platform to carry a nativity angel statue thereon.

26. The combined structures of claim 24, wherein a platform is engageable to and between the front center legs of the accessory structure lower than the floor level of the nativity stable structure to carry a nativity statue of baby Jesus thereon.

27. The combined structures of claim 24, wherein the roof cover overhangs a front, sides and back of the structure and is painted or decorated to resemble a roof of a stable.

28. The combined structures of claim 24, wherein the connectors hold the legs, uprights and horizontals together frictionally.

29. The combined structures of claim 24, wherein the roof framework bent rods are angled at each end thereof.

30. The combined structures of claim 24, wherein the roof framework is angled from a center high peak to lateral lows.

31. A method for creating a nativity stable structure from a kit comprising the steps of:

opening up the kit which comes in a shipping container, locating an area for building the nativity stable structure, setting out telescopic legs of the nativity stable structure at appropriate positions to create the nativity stable structure, engaging the legs together with horizontal floor support structures, adjusting the telescopic legs to ensure that the horizontal floor support structures are level relative to the supporting surface beneath the nativity stable structure, engaging uprights to the legs forming front and rear corners of the nativity stable structure, engaging taller uprights to center rear legs of the nativity stable structure, engaging a roof framework to tops of the uprights to create a roof framework for the nativity stable structure, engaging a plurality of roof support rods between front and rear roof framework elements;

placing floor panels on the horizontal support structures for same, placing a roof cover over the roof framework, hanging at least one of a side panel and a rear panel on the nativity stable structures, and placing desired nativity statues within the built nativity stable structure.

32. The method of claim 31, further including the step of engaging an accessory platform to the rear center upright to create an elevated platform above the floor of the nativity stable structure.

33. The method of claim 31, further including the step of placing an angel upon the elevated platform of nativity stable structure.

34. The method of claim 31, further including the steps of engaging an accessory kit to the nativity stable structure, comprising the steps of:

engaging accessory floor support structure to the front of the nativity stable structure, which accessory floor support structure extending forwardly of the front of the nativity stable structure at a level below the floor of the nativity stable structure and comprising a plurality of uprights to which are engaged horizontal support structures upon which accessory floor panels are engaged, placing accessory roof support structures upon the front roof support structures of the nativity stable structure, placing front roof support structures of the nativity stable structure upon front uprights of the accessory kit, placing a cover over the roof of the nativity stable structure and added accessory roof structure formed from the accessory kit, hanging at least one more side panel on a front side wall area formed by addition of the accessory kit, placing accessory floor panels on the accessory floor support structure, and placing one or more nativity statues on the accessory floor panels.

35. The method of claim 34, further including the step of engaging an accessory platform to front center legs of the nativity stable structure at a position above the floor of the accessory kit.

36. The method of claim 35, wherein the baby Jesus is positioned on the accessory platform for ease of viewing.

37. The method of claim 35, wherein a pair of bent end rods is positioned to extend between forward center legs of the stable structure and shorter center uprights of the accessory kit.

38. The method of claim 31, comprising the further step of providing low voltage lighting for the nativity statues.

39. A nativity stable structure for use in an outdoor environment and for displaying nativity statues, comprising at least three nativity statues at least 24 inches in height, a framework creating at least one side wall, a rear wall, a floor supporting frame, a roof and adjustable legs which are adjustable to accommodate an uneven supporting surface, said framework comprising a plurality of framework pieces, a plurality of one way, two way and three way connectors frictionally engaged to connect framework pieces together, and having floor panels on which said at least three nativity statues are placed are engaged to the floor supporting frame, the roof, the rear wall and at least one side wall being covered to protect the at least three nativity statues placed on the floor panels at a position above the supporting surface from the environment.

40. The nativity stable structure of claim 39, wherein the at least one side, rear wall and roof are decorated to appear as a stable.

41. A nativity stable structure for use in an outdoor environment and displaying nativity statues, comprising at least three nativity statues, a framework creating at least one side wall, a rear wall, a floor supporting frame, a roof and adjustable legs which are adjustable to accommodate an uneven supporting surface, and having floor panels on which said at least three nativity statues are placed are engaged to the floor supporting frame, the roof, the rear wall, at least one side wall being covered to protect the at least three nativity statutes placed on the floor panels at a position above the supporting surface from the environment, and an accessory frame work including a forward lower level framework for engaging a second set of floor panels at a position below that of the first set but above the supporting surface.

42. The nativity stable structure of claim 41, further includes an accessory platform which is positionable above the first set of floor panels at a rear of the nativity stable structure or is positionable between the first set of floor panels and the second set of floor panels, at a forward center position of the nativity stable structure.

43. The nativity stable structure of claim 42, wherein the accessory platform mounts thereon an angel statue when engaged at the rear of the nativity stable structure.

44. The nativity stable structure of claim 42, wherein the accessory platform mounts thereon a baby Jesus statue when engaged between the first set of floor panels and the second set of floor panels, at a forward center position of the nativity stable structure.

45. The nativity stable structure of claim 41, wherein said side wall and roof are extended to cover and protect nativity statues supported on both the first and second sets of floor panels.

46. The nativity stable structure of claim 41, wherein the forward lower level framework includes legs telescopically adjustable to allow for leveling of the forward lower level floor framework.

47. The nativity stable structure of claim 41, wherein the side wall and roof are decorated to give the appearance of a stable.

48. The nativity stable structure of claim 41, accommodating nativity statues at least one of 12, 24, 36, 48, 60, 72 or greater inches tall.

49. A nativity stable structure for use in an outdoor environment set upon uneven ground, and having common connectors for connecting horizontal and vertical elements of the structure, said common connectors comprising a plurality of one way, two way and three way connectors frictionally engaged to connect framework pieces together, said nativity stable structure can be built to various sizes to accommodate nativity statues of various heights from 24 inches to 72 inches using the same common connectors, and utilizing horizontal and vertical elements for the respective ones of the various sizes to accommodate a selected one of the various height nativity statutes.

50. A method for changing the size of an outdoor nativity stable structure set upon uneven ground having common connectors and horizontal elements and vertical elements, said common connectors comprising a plurality of one way, two way and three way connectors frictionally engaged to connect framework pieces together, comprising the steps of:

obtaining a nativity stable structure having common connectors and horizontal elements, roof elements and vertical elements to create a nativity stable structure of a size to accommodate nativity statues of a first height of at least 24 inches, and using the plurality of one way, two way and three way connectors with at least some different horizontal elements, roof elements and vertical elements to create a nativity stable structure of a different size to accommodate nativity statues of a different, second height of greater than 24 inches.

* * * * *